US010028631B2

(12) United States Patent
Jung et al.

(10) Patent No.: US 10,028,631 B2
(45) **Date of Patent: *Jul. 24, 2018**

(54) ROBOT CLEANER HAVING DUST SENSING UNIT

(71) Applicant: SAMSUNG ELECTRONICS CO., LTD., Suwon-si, Gyeonggi-do (KR)

(72) Inventors: Hyun Soo Jung, Seongnam-si (KR); Dong Won Kim, Hwaseong-si (KR); Jun Hwa Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 214 days.

This patent is subject to a terminal disclaimer.

(21) Appl. No.: 14/885,357

(22) Filed: Oct. 16, 2015

(65) Prior Publication Data

US 2016/0029865 A1 Feb. 4, 2016

Related U.S. Application Data

(63) Continuation of application No. 13/183,723, filed on Jul. 15, 2011, now Pat. No. 9,186,030.

(30) Foreign Application Priority Data

Jul. 15, 2010 (KR) ..... 10-2010-0068670
Nov. 2, 2010 (KR) ..... 10-2010-0108235

(51) Int. Cl.
*A47L 9/28* (2006.01)
*A47L 9/10* (2006.01)
*A47L 9/30* (2006.01)

(52) U.S. Cl.
CPC ..... *A47L 9/2805* (2013.01); *A47L 9/106* (2013.01); *A47L 9/28* (2013.01); *A47L 9/2815* (2013.01);

(Continued)

(58) Field of Classification Search
CPC ..... A47L 2201/00; A47L 2201/06; A47L 9/2815; A47L 9/28

(Continued)

(56) References Cited

U.S. PATENT DOCUMENTS 4,601,082 A 7/1986 Kurz
5,141,309 A 8/1992 Worwag (Continued)

FOREIGN PATENT DOCUMENTS

CN 1470368 1/2004
CN 1669514 9/2005

(Continued)

OTHER PUBLICATIONS

Korean Office Action dated Oct. 21, 2015 in related Korean Application No. 10-2014-0112193.

(Continued)

*Primary Examiner* — Christopher M Koehler
*Assistant Examiner* — Henry Hong
(74) *Attorney, Agent, or Firm* — Staas & Halsey LLP

(57) ABSTRACT

A robot cleaner includes a body; a driving unit; at least one sensor configured to detect an obstacle; a cleaning unit, the cleaning unit including a brush unit and a fan unit; a dust box to store dust inside of the dust box, the dust box being detachably mounted to the body; and a dust sensing unit including a light emitting unit to transmit light and a light receiving sensor to sense the light transmitted by the light emitting unit, the light emitting unit and the light receiving sensor being fixed on the body and outside of the dust box, and the light emitting unit being configured to transmit light through the inside of the dust box. The driving unit, the at least one sensor, the cleaning unit, the dust box, and the dust sensing unit are positioned on or in the body of the robot cleaner.

18 Claims, 29 Drawing Sheets

(52) U.S. Cl.
CPC ..... *A47L 9/30* (2013.01); *A47L 2201/00* (2013.01); *A47L 2201/024* (2013.01); *A47L 2201/028* (2013.01); *A47L 2201/04* (2013.01); *A47L 2201/06* (2013.01)

(58) Field of Classification Search
USPC ..... 15/319
See application file for complete search history.

(56) References Cited

U.S. PATENT DOCUMENTS

| | | | | |
|---|---|---|---|---|
| 5,163,202 | A * | 11/1992 | Kawakami | A47L 9/2815 15/319 |
| 5,182,833 | A | 2/1993 | Yamaguchi et al. | |
| 5,319,827 | A * | 6/1994 | Yang | A47L 9/2815 15/319 |
| 5,819,367 | A | 10/1998 | Imamura | |
| 6,446,302 | B1 | 9/2002 | Kasper et al. | |
| 7,562,414 | B2 | 7/2009 | Oh et al. | |
| 7,921,506 | B2 * | 4/2011 | Baek | A47L 9/1472 15/319 |
| 2005/0166355 | A1 * | 8/2005 | Tani | A47L 9/2805 15/319 |
| 2005/0183230 | A1 | 8/2005 | Uehigashi | |
| 2008/0047092 | A1 * | 2/2008 | Schnittman | A47L 9/106 15/319 |
| 2008/0301899 | A1 | 12/2008 | Blocker et al. | |
| 2009/0044370 | A1 | 2/2009 | Won et al. | |

FOREIGN PATENT DOCUMENTS

| | | | |
|---|---|---|---|
| CN | 1748626 | A | 3/2006 |
| CN | 1833594 | | 9/2006 |
| CN | 2843326 | | 12/2006 |
| CN | 1889881 | | 1/2007 |
| CN | 101036568 | A | 9/2007 |
| CN | 101273860 | A | 10/2008 |
| CN | 201641878 | | 11/2010 |
| EP | 1 836 941 | | 3/2007 |
| JP | 2002-143060 | | 5/2002 |
| JP | 2003-144363 | | 5/2003 |
| JP | 2005-211493 | | 8/2005 |
| JP | 2007-97984 | | 4/2007 |
| JP | 2007-117142 | | 5/2007 |
| KR | 1999-0048500 | | 7/1999 |
| KR | 2003-0044119 | | 6/2003 |
| KR | 10-0565254 | | 3/2006 |
| KR | 10-2007-0074146 | | 7/2007 |
| KR | 10-2007-0091416 | | 9/2007 |
| KR | 10-0849554 | | 7/2008 |
| KR | 10-2009-0018287 | | 2/2009 |
| KR | 10-1103910 | | 1/2012 |
| WO | 01/08544 | | 2/2001 |
| WO | WO 2005/055795 | | 6/2005 |
| WO | WO 2007/137234 | | 11/2007 |
| WO | 2009/011542 | | 1/2009 |
| WO | 2009/011542 | A1 | 1/2009 |

OTHER PUBLICATIONS

European Office Action dated Feb. 9, 2017 from European Patent Application No. 12005268.3, 4 pages.
European Office Action dated Jan. 5, 2017 from European Patent Application No. 11173746.6, 76 pages.
Chinese Office Action dated May 15, 2017 in corresponding Chinese Patent Application No. 201610647435.4.
Chinese Office Action dated Apr. 29, 2016 from Chinese Patent Application No. 201110210112.6, 26 pages.
Chinese Office Action dated May 24, 2016 from Chinese Patent Application No. 201110210121.5, 21 pages.
Korean Office Action dated Aug. 22, 2016 from Korean Patent Application No. 10-2016-0094501, 10 pages.
European Office Action dated Oct. 25, 2016 from European Patent Application No. 11173893.6, 4 pages.
European Office Action dated Oct. 21, 2016 from European Patent Application No. 11173894.4, 4 pages.
Chinese Office Action dated Oct. 9, 2016 from Chinese Patent Application No. 201110210121.5, 4 pages.
Chinese Office Action dated Oct. 21, 2016 from Chinese Patent Application No. 201110210112.6, 4 pages.
European Decision on Grant dated Feb. 6, 2015 in corresponding European Patent Application No. 11173747.4.
Chinese Office Action dated Apr. 15, 2015 in corresponding Chinese Patent Application No. 201110210112.6.
Korean Office Action dated Sep. 3, 2014 in corresponding Korean Patent Application No. 10-2010-0108235.
European Search Report dated Oct. 15, 2012 in corresponding European Application No. 11173747.4-2316.
European Search Report dated Oct. 15, 2012 in corresponding European Application No. 11173893.6-2316.
European Search Report dated Oct. 5, 2012 in corresponding European Application No. 11173894.4-2316.
European Search Report dated Oct. 5, 2012 in corresponding European Application No. 11173746.6-2316.
European Search Report dated Oct. 1, 2012 in corresponding European Application No. 12005268.3-2316.
U.S. Office Action dated Jan. 17, 2014 in copending U.S. Appl. No. 13/183,723.
U.S. Office Action dated Oct. 21, 2014 in copending U.S. Appl. No. 13/183,723.
U.S. Office Action dated Mar. 13, 2015 in copending U.S. Appl. No. 13/183,723.
U.S. Notice of Allowance dated Aug. 14, 2015 in copending U.S. Appl. No. 13/183,723.
U.S. Appl. No. 13/183,723, filed Jul. 15, 2011, Hyun Soo Jung, Samsung Electronics Co., Ltd.
Chinese Office Action dated Dec. 18, 2017 in Chinese Patent Application No. 201610647435.4.

* cited by examiner

ROBOT CLEANER HAVING DUST SENSING UNIT

CROSS-REFERENCE TO RELATED APPLICATIONS

This application is a continuation of U.S. application Ser. No. 13/183,723 filed on Jul. 15, 2011, which claims the benefit of Korean Patent Application Nos. 10-2010-0068670 and 10-2010-0108235, respectively filed on Jul. 15, 2010 and Nov. 2, 2010 in the Korean Intellectual Property Office, the disclosures of which are incorporated herein by reference.

BACKGROUND

1. Field

Embodiments of the present disclosure relate to a system for performing a cleaning operation using an autonomous robot.

2. Description of the Related Art

An autonomous robot is a device for performing a desired task while traveling about a certain region without being operated by a user. Such a robot may substantially operate autonomously. Autonomous operation may be achieved in various manners. In particular, a robot cleaner is a device for removing dust from a floor while traveling about a region to be cleaned without being operated by a user. In detail, such a robot cleaner may perform a vacuum cleaning operation and a wiping operation in a home. Here, dust may mean (soil) dust, mote, powder, debris, and other dust particles.

SUMMARY

Therefore, it is an aspect of the present disclosure to provide a cleaning system capable of preventing the cleaning performance of a robot cleaner from being degraded.

Additional aspects of the disclosure will be set forth in part in the description which follows and, in part, will be obvious from the description, or may be learned by practice of the disclosure.

In accordance with one aspect of the present disclosure, a robot cleaner includes a body having an opening, a dust box provided at the body, to store dust, and a brush unit provided at the opening of the body, to sweep dust on a floor into the dust box, wherein the dust swept into the dust box is suspended in air introduced into the dust box through the opening of the body, and is then discharged through the opening of the body.

The air may be introduced into the dust body through a side region of the opening of the body, and may then be outwardly discharged through a central region of the opening of the body.

The robot cleaner may further include a brush unit provided at the body such that the brush unit is rotatable. The brush unit may be controlled to allow dust to be more effectively discharged.

The brush unit may include a roller, and the roller of the brush unit changes a rotation direction at least one time during the dust discharge.

During the dust discharge, the roller of the brush unit may rotate slowly in an initial period of time when light dust is discharged, and may then rotate rapidly.

The robot cleaner may further include a maintenance station to generate a flow to discharge air toward the body, and a flow to suck air from the body. The opening of the body may communicate with an opening provided at the maintenance station.

In accordance with another aspect of the present disclosure, a maintenance station blows air into a dust box included in a robot cleaner through an opening of the robot cleaner where a brush unit is installed, and sucks dust stored in the dust box while being suspended in the air blown into the dust box.

The air sucked from the dust box of the robot cleaner may be re-blown into the dust box through the opening of the robot cleaner.

The maintenance station may further include an opening to communicate with the opening of the robot cleaner. The dust stored in the dust box of the robot cleaner may be discharged to the opening of the robot cleaner, so as to be introduced into the opening of the maintenance station.

The maintenance station may further include a pump unit, a suction duct provided at a suction side of the pump unit, and a discharge duct provided at a discharge side of the pump unit. The suction duct may have a suction port arranged at the opening of the maintenance station, and the discharge duct may have a discharge port arranged at the opening of the maintenance station.

The maintenance station may further include a pump unit, a suction duct provided at a suction side of the pump unit, and a discharge duct provided at a discharge side of the pump unit. The suction duct may have a suction port arranged at the opening of the maintenance station. The discharge duct may have a discharge port. The suction port and the discharge port may form the opening of the maintenance station.

The suction port of the suction duct may be formed at a large region of the opening in the maintenance station in a longitudinal direction of the opening, and the discharge port of the discharge duct may be formed at an end region of the opening as viewed in the longitudinal direction of the opening.

The suction port of the suction duct may have a larger cross-sectional area than the discharge port of the discharge duct.

The maintenance station may further include a dust box arranged between the suction duct and the pump unit. Air discharged from the pump unit may be circulated to the pump unit after sequentially passing through the discharge duct, the opening of the robot cleaner, the dust box of the robot cleaner, the opening of the robot cleaner, the suction duct, and the dust box of the maintenance station.

The discharge duct may include a first discharge duct having a first discharge port to allow air to be blown into a larger dust box included in the dust box of the robot cleaner, and a second discharge port to allow air to be blown into a smaller dust box included in the dust box of the robot cleaner.

The first and second discharge ports of the first discharge duct may be arranged at opposite ends of the second opening in a width direction in one side region of the second opening, respectively.

The discharge duct may include a second discharge duct having a third discharge port to allow air to be blown into a larger dust box included in the dust box of the robot cleaner, and a fourth discharge port to allow air to be blown into a smaller dust box included in the dust box of the robot cleaner.

The third and fourth discharge ports of the first discharge duct may be arranged at opposite ends of the second opening in a width direction in the other side region of the second opening, respectively.

The maintenance station may further include a suction/discharge dual tube to guide air to be blown to a sensor provided at the robot cleaner and to be again sucked from the sensor.

The maintenance station may further include a pump unit, a suction duct provided at a suction side of the pump unit, and a discharge duct provided at a discharge side of the pump unit. The suction duct may communicate with a suction tube of the suction/discharge dual tube, and the discharge duct may communicate with a discharge tube of the suction/discharge dual tube.

The maintenance station may further include a pump unit, a suction duct provided at a suction side of the pump unit, and a port assembly to divide the suction duct into two portions respectively having first and second suction ports.

The port assembly may include a suction port forming member to form the first and second suction ports.

The second suction port may surround at least a portion of the first suction port.

The first suction port may be provided at a position substantially corresponding to the opening of the robot cleaner. At least a portion of the second suction port is arranged outside the opening of the robot cleaner.

A cover having a plurality of through holes may be provided at the second suction port.

The maintenance station may further include a pump unit, first and second discharge ducts provided at a discharge side of the pump unit, and a port assembly to divide the first discharge duct into two portions respectively having first and second discharge ports, and to divide the second discharge duct into two portions respectively having third and fourth discharge ports.

The port assembly may include a first discharge port forming member to form the first discharge port, a second discharge port forming member to form the second discharge port, a third discharge port forming member to form the third discharge port, and a fourth discharge port forming member to form the fourth discharge port.

The second suction port may surround at least a portion of each of the first, second, third and fourth discharge ports.

The port assembly may further include a plurality of brush cleaning members to clean the brush unit of the robot cleaner.

Each of the plural brush cleaning members may include a guide extending inclinedly with respect to a rotation direction of the brush unit, and at least one hook protruded from a side surface of the guide.

The port assembly may be detachably mounted to the opening of the maintenance station.

The port assembly may further include a first spacer provided at a bottom of the port assembly, and second spacers provided at opposite sides of the first spacer.

The opening of the maintenance station may be larger than the opening of the robot cleaner.

The maintenance station may further include a pump unit, and a suction duct provided at a suction side of the pump unit. The suction duct may have a suction port, which is larger than the opening of the robot cleaner.

In accordance with another aspect of the present disclosure, a cleaning system includes a robot cleaner including a first opening, and a first dust box communicating with the first opening, and a maintenance station including a second opening, and a second dust box communicating with the second opening, wherein dust stored in the first dust box of the robot cleaner is discharged to the second opening of the maintenance station through the first opening of the robot cleaner after being suspended in air introduced into the first dust box of the robot cleaner.

The air introduced into the first dust box of the robot cleaner may pass through the first opening of the robot cleaner.

The cleaning system may further include a dust removal unit to suck air from the first dust box of the robot cleaner through the first opening of the robot cleaner, and to again blow air to the first opening of the robot cleaner.

The dust removal unit may suck air such that the air blown to the first opening of the robot cleaner emerges from the first opening of the robot cleaner after circulating through the first dust box of the robot cleaner.

The dust removal unit may blow air in a side region of the first opening of the robot cleaner as viewed in a longitudinal direction of the first opening, and may suck air in a large region of the first opening as viewed in the longitudinal direction of the first opening.

The dust removal unit may include a pump unit, and a first discharge duct provided at a discharge side of the pump unit. The first discharge duct may have a first discharge port to allow air to be blown into a larger dust box included in the first dust box, and a second discharge port to allow air to be blown into a smaller dust box included in the first dust box.

The dust removal unit may further include a second discharge duct provided at the discharge side of the pump unit. The second discharge duct may have a third discharge port to allow air to be blown into the larger dust box of the first dust box, and a fourth discharge port to allow air to be blown into a smaller dust box included in the first dust box.

The dust removal unit may include a pump unit, and a suction duct provided at a suction side of the pump unit. The suction duct may have a suction port, which is larger than the opening of the robot cleaner.

The dust removal unit may include a pump unit, a suction duct provided at a suction side of the pump unit, first and second discharge ducts provided at a discharge side of the pump unit, and a port assembly to divide the suction duct into two portions respectively having first and second suction ports, to divide the first discharge duct into two portions respectively having first and second discharge ports, and to divide the second discharge duct into two portions respectively having third and fourth discharge ports.

The port assembly may include a suction port forming member to form the first and second suction ports, a first discharge port forming member to form the first discharge port, a second discharge port forming member to form the second discharge port, a third discharge port forming member to form the third discharge port, and a fourth discharge port forming member to form the fourth discharge port.

The second suction port may surround the first suction port, the first discharge port, the second discharge port, the third discharge port, and the fourth discharge port.

The dust removal unit may include a pump unit, a suction duct provided at a suction side of the pump unit, and a discharge duct provided at a discharge side of the pump unit. The suction duct may have a suction port arranged in a large region of the first opening of the robot cleaner in a longitudinal direction of the first opening, and the discharge duct may have a discharge port arranged at a side region of the first opening as viewed in the longitudinal direction of the first opening.

The suction port of the suction duct may have a larger cross-sectional area than the discharge port of the discharge duct.

A cross-sectional area ratio between the suction port of the suction duct and the discharge port of the discharge duct may be 7.5:1.

The suction port of the suction duct and the discharge port of the discharge duct may form the second opening of the maintenance system.

The maintenance station may further include a cover to open or close the second opening of the maintenance station.

The maintenance station may further include a bridge extending along a central portion of the second opening of the maintenance station.

The robot cleaner may further include a brush unit provided at the first opening of the robot cleaner. The brush unit may be controlled to allow dust stored in the first dust box of the robot cleaner to be more effectively discharged to the second opening of the maintenance station.

The brush unit may include a roller, and the roller of the brush unit changes a rotation direction at least one time during the dust discharge.

The roller may rotate slowly in an initial period of time when light dust is discharged, and may then rotate rapidly.

The maintenance station may further include a brush cleaning member to clean the brush unit.

The brush cleaning member may be arranged adjacent to the second opening of the maintenance station.

The brush cleaning member may include a guide extending inclinedly with respect to a rotation direction of the brush unit, and at least one hook protruded from a side surface of the guide.

The robot cleaner may further include a dust sensing unit to sense an amount of dust stored in the first dust box. The dust sensing unit may include a light emitting sensor and a light receiving sensor, which are installed at regions other than the first dust box, and a reflecting member installed in the first dust box, to reflect a signal transmitted from the light emitting sensor to the light receiving sensor.

The robot cleaner may further include a dust sensing unit to sense an amount of dust stored in the first dust box. The robot cleaner may be moved to the maintenance station when the dust amount sensed by the dust sensing unit corresponds to a predetermined amount or more.

In accordance with another aspect of the present disclosure, a cleaning system includes docking a robot cleaner at a maintenance station, determining whether or not docking is completed, discharging dust stored in the robot cleaner into the maintenance station through an opening where a brush unit included in the robot cleaner is installed, upon completion of docking, and operating a brush unit of the robot cleaner during dust discharge.

The brush unit may change a rotation direction at least one time.

The brush unit may rotate slowly in an initial period of time when light dust is discharged, and may then rotate rapidly.

The cleaning system may further include determining whether or not dust is completely filled in a dust box of the robot cleaner.

In accordance with another aspect of the present disclosure, a robot cleaner includes a body, a dust box provided at the body, to store dust, and a dust sensing unit to measure an amount of dust stored in the dust box, wherein the dust sensing unit includes a light emitting sensor installed at a region other than the dust box, to transmit a signal to an interior of the dust box, and a light receiving sensor installed at a region other than the dust box, to sense a signal emerging from the interior of the dust box.

The dust sensing unit may further include a reflecting member installed within the dust box, to reflect the signal transmitted from the light emitting sensor to the light receiving sensor.

The dust box may include at least one inlet, through which dust is introduced into the dust box. The light emitting sensor and the light receiving sensor may be provided at a portion of the body corresponding to the inlet of the dust box, to perform signal transmission and signal reception through the inlet of the dust box, respectively.

The robot cleaner may further include a display provided at the body, to display various information. The display unit may display dust sensing information from the dust sensing unit.

There may be no connecting terminal connected to the dust box.

In accordance with another aspect of the present disclosure, a robot cleaner may include a body, a dust box provided at the body, to store dust, and a dust sensing unit to measure an amount of dust stored in the dust box. The dust sensing unit may include a light emitting sensor installed at a region other than the dust box. A signal transmitted from the light emitting sensor may reach the light receiving sensor after passing through the dust box.

The dust box may be made of a transparent material to allow a signal to pass through the dust box.

The light emitting sensor and the light receiving sensor may be installed so as to face each other.

The dust box may include a transmitted-signal passing portion arranged at a position corresponding to the light emitting sensor, to allow a signal to enter the dust box, and a received-signal passing portion arranged at a position corresponding to the light receiving sensor, to allow a signal to emerge from the dust box.

The transmitted-signal passing portion and the received-signal passing portion may be made of a transparent material.

There may be no connecting terminal connected to the dust box.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, a robot cleaner, a maintenance station, and a cleaning system according to embodiments of the present disclosure will be described with reference to the accompanying drawings.

Figure 1:
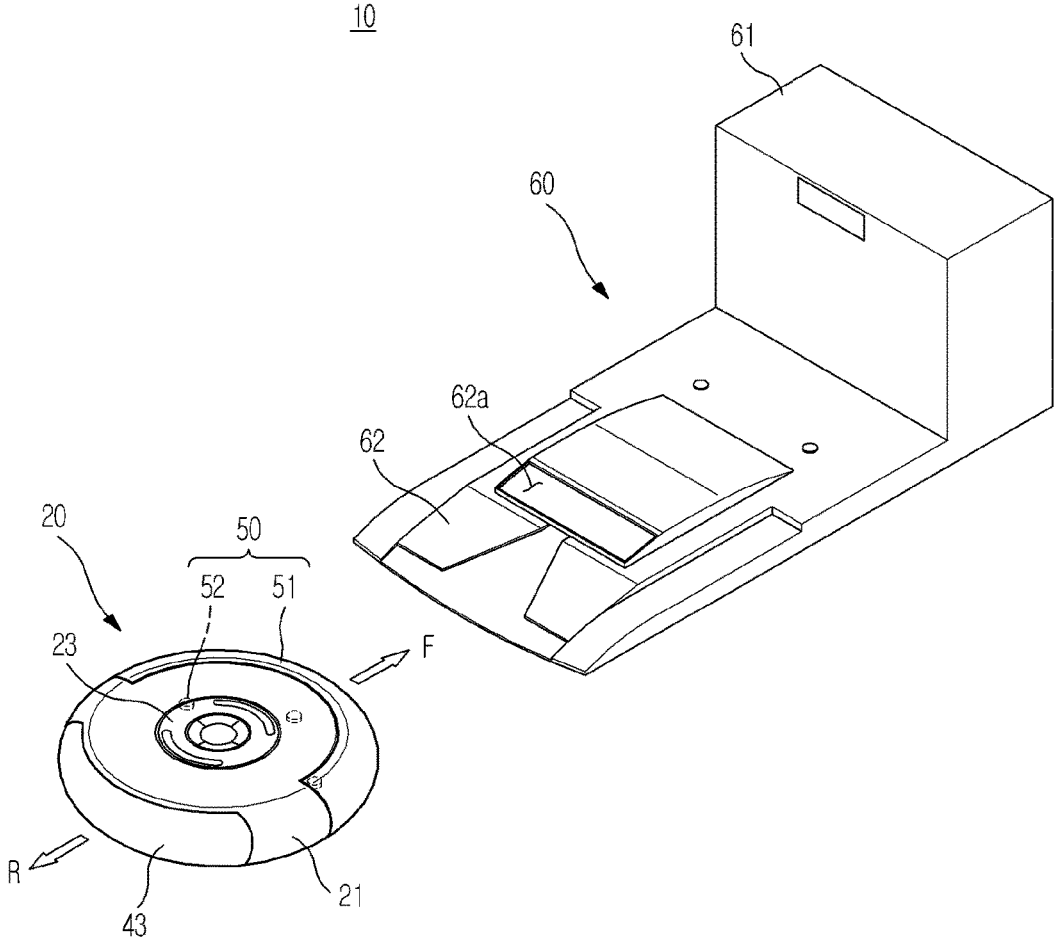
FIG. 1 is a view illustrating a cleaning system according to an exemplary embodiment of the present disclosure.

FIG. 1 is a view illustrating a cleaning system according to an exemplary embodiment of the present disclosure.

As shown in FIG. 1, the cleaning system 10 may include a robot cleaner 20 and a maintenance station 60. The robot cleaner 20 is a device for autonomously performing various cleaning tasks. The maintenance station 60 is a device for repair and maintenance. The maintenance station 60 may charge a battery of the robot cleaner 20, and empties a dust box of the robot cleaner 20.

Figure 2:
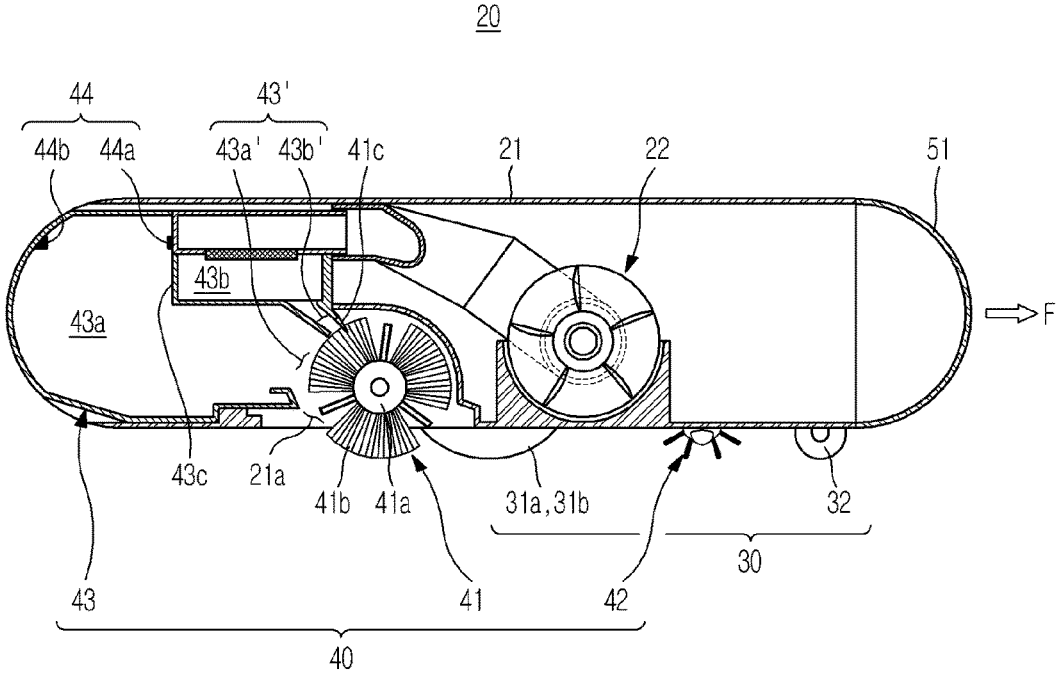
FIG. 2 is a sectional view illustrating a configuration of the robot cleaner according to an exemplary embodiment of the present disclosure.
Figure 3:
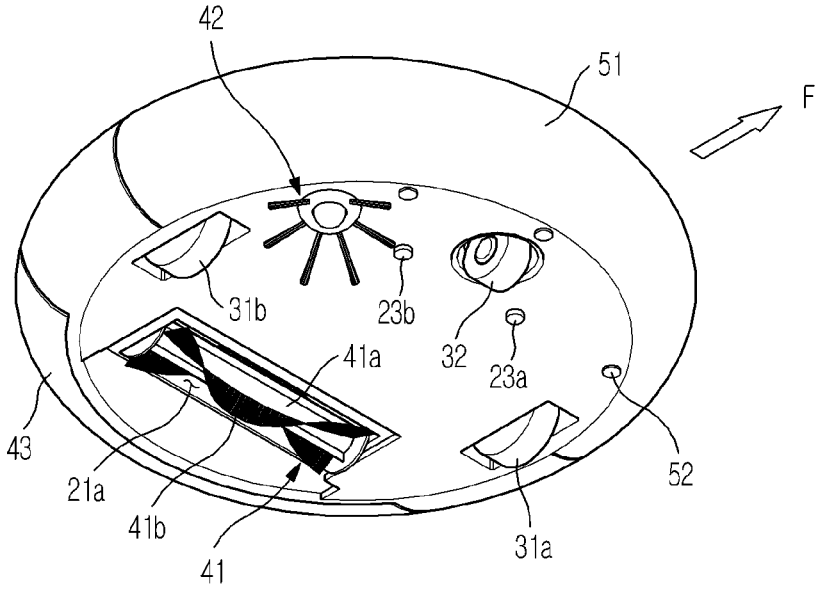
FIG. 3 is a perspective view illustrating a bottom of the robot cleaner according to the illustrated embodiment of the present disclosure.

FIG. 2 is a sectional view illustrating a configuration of the robot cleaner according to an exemplary embodiment of the present disclosure. FIG. 3 is a perspective view illustrating a bottom of the robot cleaner according to the illustrated embodiment of the present disclosure.

As shown in FIGS. 1 to 3, the robot cleaner 20 includes a body 21, a driving unit 30, a cleaning unit 40, various sensors 50, and a controller (not shown).

The body 21 may have various shapes. For example, the body 21 may have a circular shape. Where the body 21 has a circular shape, it may be prevented from coming into contact with surrounding obstacles and may easily achieve direction change, even during rotation thereof, because it has a constant radius of rotation. Also, it may be possible to prevent the body 21 from being obstructed by a surrounding obstacle during travel thereof. Thus, the body 21 cannot be trapped by an obstacle during travel thereof.

Various constituent elements to perform cleaning tasks, that is, the driving unit 30, cleaning unit 40, various sensors 50, controller (not shown), and a display 23, may be installed on the body 21.

The driving unit 30 may enable the body 21 to travel about a region to be cleaned. The driving unit 30 may include left and right driving wheels 31*a* and 31*b*, and a caster 32. The left and right driving wheels 31*a* and 31*b* are mounted to a central portion of a bottom of the body 21. The caster 32 is mounted to a front portion of the bottom of the body 21, to maintain stability of the robot cleaner 20.

The left and right driving wheels 31*a* and 31*b* may be controlled to move the robot cleaner 20 forward or backward, or to change the running direction of the robot cleaner 20. For example, it may be possible to move the robot cleaner 20 forward or backward by uniformly controlling the left and right driving wheels 31*a* and 31*b*. Also, it may be possible to change the running direction of the robot cleaner 20 by differently controlling the left and right driving wheels 31*a* and 31*b*.

Meanwhile, each of the left and right driving wheels 31*a* and 31*b*, and the caster 32 may be configured into a single assembly detachably mounted to the body 21.

The cleaning unit 40 may clean the region underneath the body 21 and surrounding portions thereof. The cleaning unit 40 may include a brush unit 41, a side brush 42, and a first dust box 43.

The brush unit 41 may be mounted to a first opening 21*a* formed through the bottom of the body 21. The brush unit 41 may be arranged at a position other than the central portion of the body 21. That is, the brush unit 41 may be arranged at a position adjacent to the driving wheels 31*a* and 31*b* while being spaced apart from the driving wheels 31*a* and 31*b* in a rearward direction R of the body 21.

The brush unit 41 may sweep dust accumulated on a floor beneath the body 21 into the first dust box 43. The brush unit 41 may include a roller 41*a* rotatably mounted to the first opening 21*a*, and a brush 41*b* fixed to an outer peripheral surface of the roller 41*a*. When the roller 41*a* rotates, the brush 41*b*, which is made of an elastic material, may sweep up dust accumulated on the floor. In accordance with this sweeping operation, the dust accumulated on the floor may be collected in the first dust box 43 through the first opening 21*a*.

The brush unit 41 may be controlled to rotate at a constant speed, in order to exhibit a uniform cleaning performance. When the brush unit 41 cleans a rough floor surface, the rotating speed thereof may be lowered, as compared to the case in which the brush unit 41 cleans a smooth floor surface. In this case, an increased amount of current may be supplied to keep the speed of the brush unit 41 constant.

The side brush 42 may be rotatably mounted to a peripheral portion of the bottom of the body 21 at one side of the body 21. The side brush 42 may be mounted at a position spaced apart from the central portion of the body 21 in a forward direction F while being biased toward one side of the body 21.

The side brush 42 may move dust accumulated around the body 21 to the brush unit 41. The side brush 42 may expand the cleaning zone of the robot cleaner 20 to the bottom of the body 21 and surroundings thereof. The dust moved to the brush unit 41 may be collected in the first dust box 43 through the first opening 21*a*, as described above.

The first dust box 43 may be mounted to a rear portion of the body 21. The first dust box 43 includes an inlet 43' communicating with the first opening 21*a*, to allow dust to be introduced into the first dust box 43.

The first dust box 43 may be divided into a larger dust box 43*a* and a smaller dust box 43*b* by a partition 43*c*. The brush unit 41 may sweep dust having a relatively-large size into the larger dust box 43*a* via the first inlet 43*a*'. A fan unit 22 may be provided to suck small-size dust such as hairs via a second inlet 43*b*', and thus to collect the dust in the smaller dust box 43*b*. In particular, a brush cleaning member 41*c* is arranged at a position adjacent to the second inlet 43*b*'. The brush cleaning member 41*c* removes hairs wound around the brush unit 41, and then collects the removed hairs in the smaller dust box 43*b* via the second inlet 43*b*', using a suction force of the fan unit 22.

Meanwhile, each of the brush unit 41, side brush 42, and first dust box 43 may be configured into a single assembly detachably mountable to the body 21.

Figure 4A:
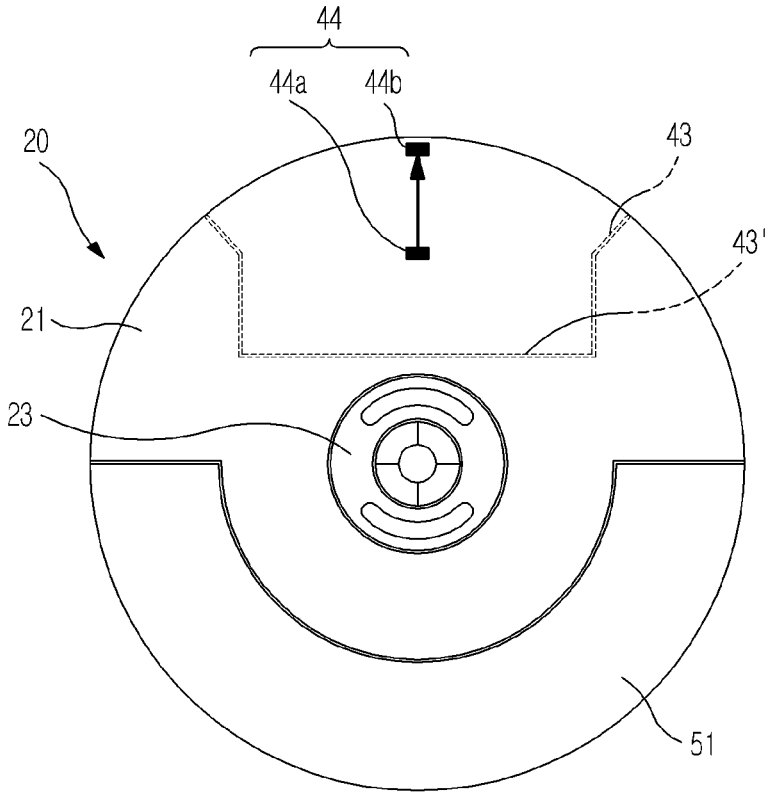
FIG. 4A is a plan view illustrating a dust sensing unit according to an exemplary embodiment of the present disclosure.
Figure 4B:
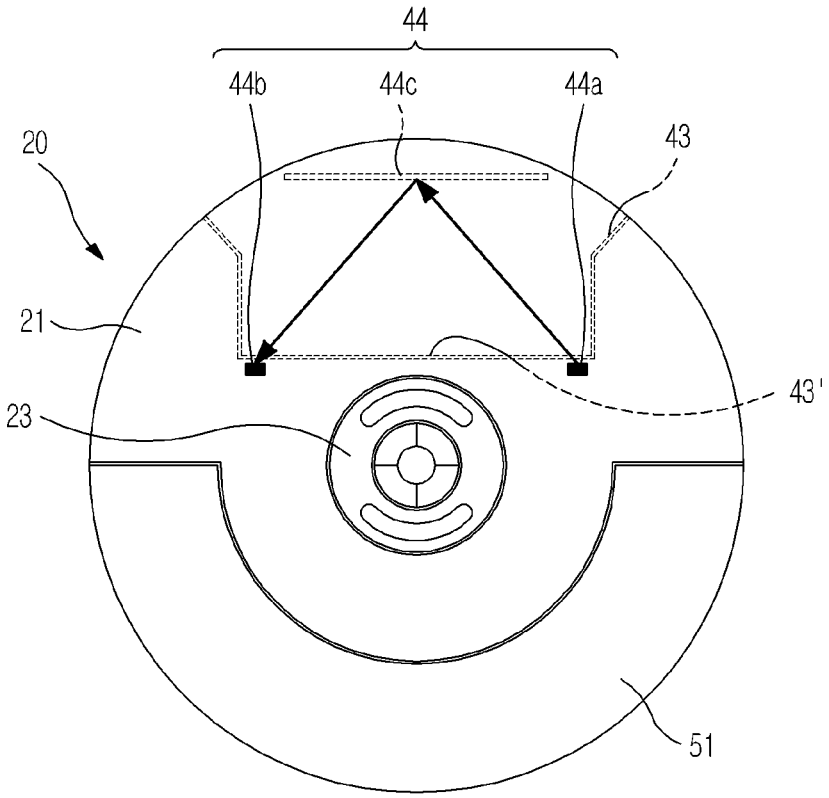
FIG. 4B is a plan view illustrating a dust sensing unit according to another exemplary embodiment of the present disclosure.
Figure 4C:
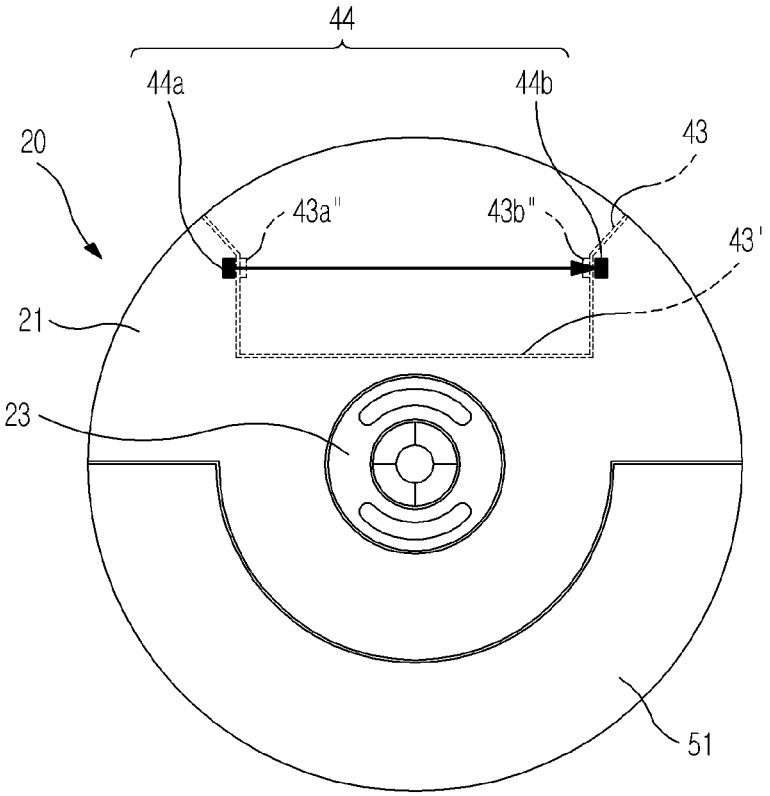
FIG. 4C is a plan view illustrating a dust sensing unit according to another exemplary embodiment of the present disclosure.

FIG. 4A is a plan view illustrating a dust sensing unit according to an exemplary embodiment of the present disclosure. FIG. 4B is a plan view illustrating a dust sensing unit according to another exemplary embodiment of the present disclosure. FIG. 4C is a plan view illustrating a dust sensing unit according to another exemplary embodiment of the present disclosure.

As shown in FIG. 4A, the dust sensing unit may be installed within the first dust box 43, in order to sense the amount of dust in the first dust box 43.

In this case, the dust sensing unit 44 may include a light emitting sensor 44*a* and a light receiving sensor 44*b*. A signal transmitted from the light emitting sensor 44*a* within the first dust box 43 may be directly received by the light receiving sensor 44*b*.

Each of the light emitting sensor 44*a* and light receiving sensor 44*b* may include a photodiode or a phototransistor. In this case, it may be possible to determine whether or not the first dust box 43 is completely filled with dust, based on the amount of energy sensed by the photodiode or phototransistor. That is, as dust is accumulated in the first dust box 43, the amount of energy sensed by the photodiode or phototransistor may be considerably reduced. Through comparison of the sensed energy amount with a predetermined reference value, the controller may determine that the first dust box 43 is completely filled with dust, when the sensed energy amount is less than the reference value. Since the light emitting sensor 44*a* and light receiving sensor 44*b*, which are configured by photodiodes or phototransistors, are considerably influenced by disturbance, it may be possible to more accurately sense the amount of dust where a structure such as a slit or a light guide is installed to guide a signal transmitted from the light emitting sensor 44*a* or a signal received by the light receiving sensor 44*b*.

Each of the light emitting sensor 44*a* and light receiving sensor 44*b* may also be configured by a remote-controller receiving module. In this case, it may be possible to determine whether or not the first dust box 43 is completely filled with dust, based on whether or not a signal has been received by the light receiving sensor 44*b*. That is, when dust is accumulated, the light receiving sensor 44*b* may not receive a signal transmitted from the light emitting sensor 44*a*. In this case, the controller may determine that the amount of dust in the first dust box 43 corresponds to a predetermined amount or more. The light emitting sensors 44*a* and light receiving sensor 44*b*, which are remote-controller receiving modules, may not require a slit or light guide structure because they filter low-frequency waves while exhibiting high intensity and sensitivity.

For the signal transmitted from the light emitting sensor 44*a* and received by the light receiving sensor 44*b*, visible light, infrared light, sound waves, ultrasonic waves, etc. may be used.

Meanwhile, as shown in FIG. 4B, the dust sensing unit 44 may include a light emitting sensor 44*a*, a light receiving sensor 44*b*, and a reflecting member 44*c*.

In this case, the light emitting sensor 44*a* and light receiving sensor 44*b* are not installed within the first dust box 43, but are instead installed in an area other than the first dust box 43. That is, the light emitting sensor 44*a* and light receiving sensor 44*b* may be installed at a portion of the body 21 facing the first dust box 43. In detail, the light emitting sensor 44*a* and light receiving sensor 44*b* may be installed adjacent to the inlet 43' of the first dust box 43. In this case, accordingly, the light emitting sensor 44*a* may transmit a signal into the first dust box 43 through the inlet 43'. The light receiving sensor 44*b* may receive the signal, which emerges from the first dust box 43 through the inlet 43' of the first dust box 43.

The reflecting member 44*c* may be installed within the first dust box 43. The reflecting member 44*c* may reflect a signal emitted from the light emitting sensor 44*a* toward the light receiving sensor 44*b*.

When the first dust box 43 is completely filled with dust in this case, the reflecting member 44*c* is shielded by the dust, so that the signal emitted from the light emitting sensor 44*a* cannot be received by the light receiving sensor 44*b*, or the amount of energy received by the light receiving sensor 44*b* is considerably reduced. In this state, accordingly, the controller may determine that the first dust box 43 is filled with a predetermined amount of dust or more.

Meanwhile, where the light emitting sensors 44*a* and light receiving sensors 44*b* are configured by remote-controller modules, it may be unnecessary to use a slit or light guide structure because the light emitting sensors 44*a* and light receiving sensors 44*b* filter low-frequency waves while exhibiting high intensity and sensitivity, as described above. That is, the light emitting sensors 44*a* and light receiving sensors 44*b*, which are configured by remote-controller modules, may determine whether or not the first dust box 43 is completely filled with dust, even though there is no structure such as the reflecting member 44*c* within the first dust box 43.

Since the light emitting sensor 44*a* and light receiving sensor 44*b* may not be installed within the first dust box 43, as described above, it may be unnecessary to install an electrical connecting terminal within the first dust box 43. Accordingly, the user may clean the first dust box 43, using water.

The dust sensing unit 44 may also include a light emitting sensor 44*a* and a light receiving sensor 44*b*, which are configured as shown in FIG. 4C.

In this case, the light emitting sensor 44*a* and light receiving sensor 44*b* need not be installed within the first dust box 43, and may instead be installed at regions other than the first dust box 43. That is, the light emitting sensors 44*a* and light receiving sensors 44*b* may be installed on the body 21, to face each other. In detail, the light emitting sensor 44*a* may be installed at a portion of the body 21 facing one side of the first dust box 43, whereas the light receiving sensor 44*b* may be installed at another portion of the body 21 facing the other side of the first dust box 43. In this case, the first dust box 43 is arranged between the light emitting sensor 44*a* and the light receiving sensor 44*b*, so that a signal transmitted from the light emitting sensor 44*a* may be received by the light receiving sensor 44*b* through the first dust box 43. The first dust box 43 may be formed to be completely transparent, so as to allow a signal to pass therethrough. The first dust box 43 may include a transparent transmitted-signal passing portion 43*a*" at a position corresponding to the light emitting sensor 44*a*, in order to allow a signal to pass therethrough, and a transparent received-signal passing portion 43*b*" at a position corresponding to the light receiving sensor 44*b*, in order to allow a signal to pass therethrough.

The signal transmitted from the light emitting sensor 44*a* may be directly received by the light receiving sensor 44*b*. When the first dust box 43 is completely filled with dust, the light receiving sensor 44*b* does not sense any signal, or the amount of energy sensed by the light receiving sensor 44*b* may be considerably reduced. In this case, the controller may determine that the first dust box 43 is completely filled with dust.

Since an electrical connecting structure is not installed within the first dust box 43, it may be possible to clean the first dust box 43, using water.

When the dust sensing unit 44 senses a predetermined amount of dust or more, the robot cleaner 20 may display information about the sensed result on the display 23. The user may directly clean the first dust box 43. Meanwhile, the robot cleaner 20 may automatically dock with the maintenance station 60, to automatically discharge dust collected in the first dust box 43.

The various sensors 50, which are mounted to the body 21, may be used to sense obstacles. As these sensors 50, a contact sensor, a proximity sensor, etc. may be used. For example, a bumper 51, which is arranged at a front portion of the body 21, to be directed to a front direction F of the body 21, may be used to sense a front obstacle such as a wall. It may also be possible to sense a front obstacle, using an infrared sensor (or an ultrasonic sensor).

An infrared sensor 52 (or an ultrasonic sensor), which is arranged on the bottom of the body 21, may be used to sense a condition of the floor, for example, condition of steps. A plurality of infrared sensors 52 may be installed on the bottom of the body 21 along an arc-shaped peripheral portion of the body 21.

Various sensors other than the above-described sensors may also be installed on the body 21, to transfer various conditions of the robot cleaner 20 to the controller.

The controller receives signals from the various sensors 50, and controls the driving unit 30 and cleaning unit 40, based on the received signals, thereby more efficiently controlling the robot cleaner 20.

Figure 5A:
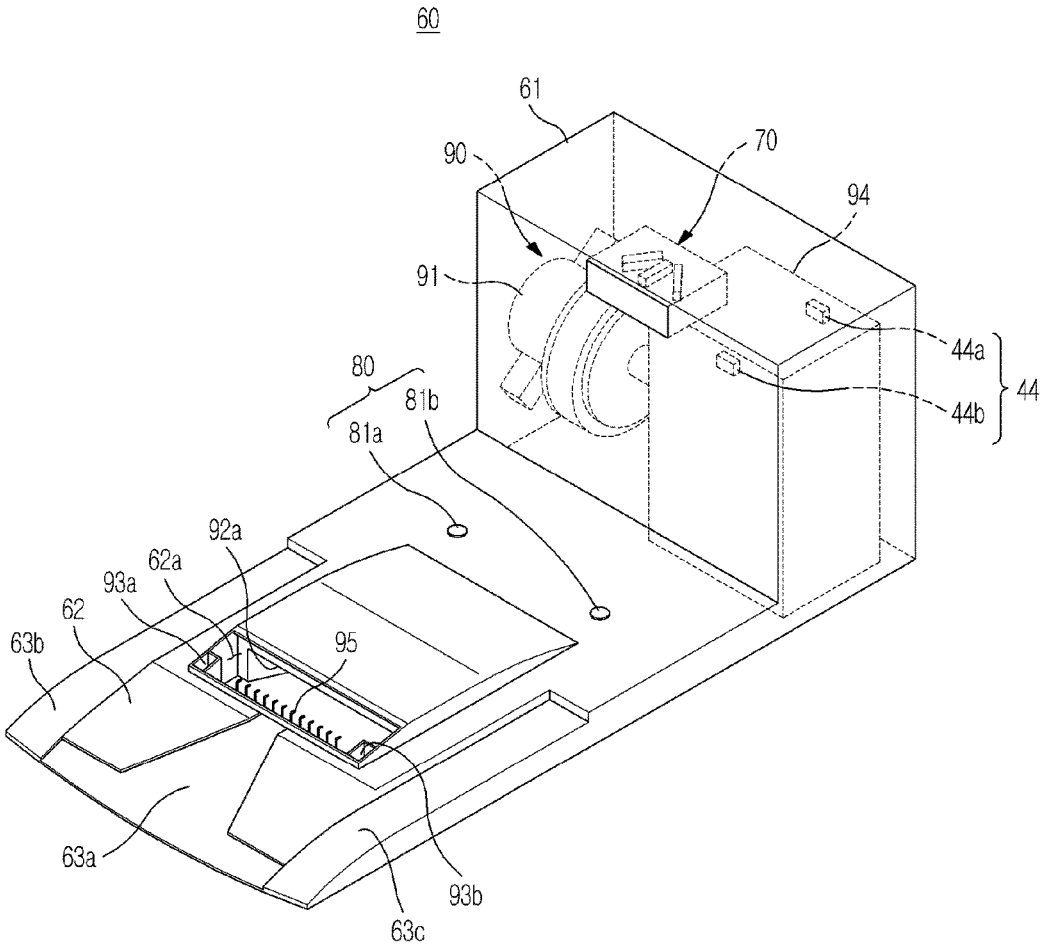
FIG. 5A is a top perspective view illustrating a configuration of a maintenance station according to an exemplary embodiment of the present disclosure.
Figure 5B:
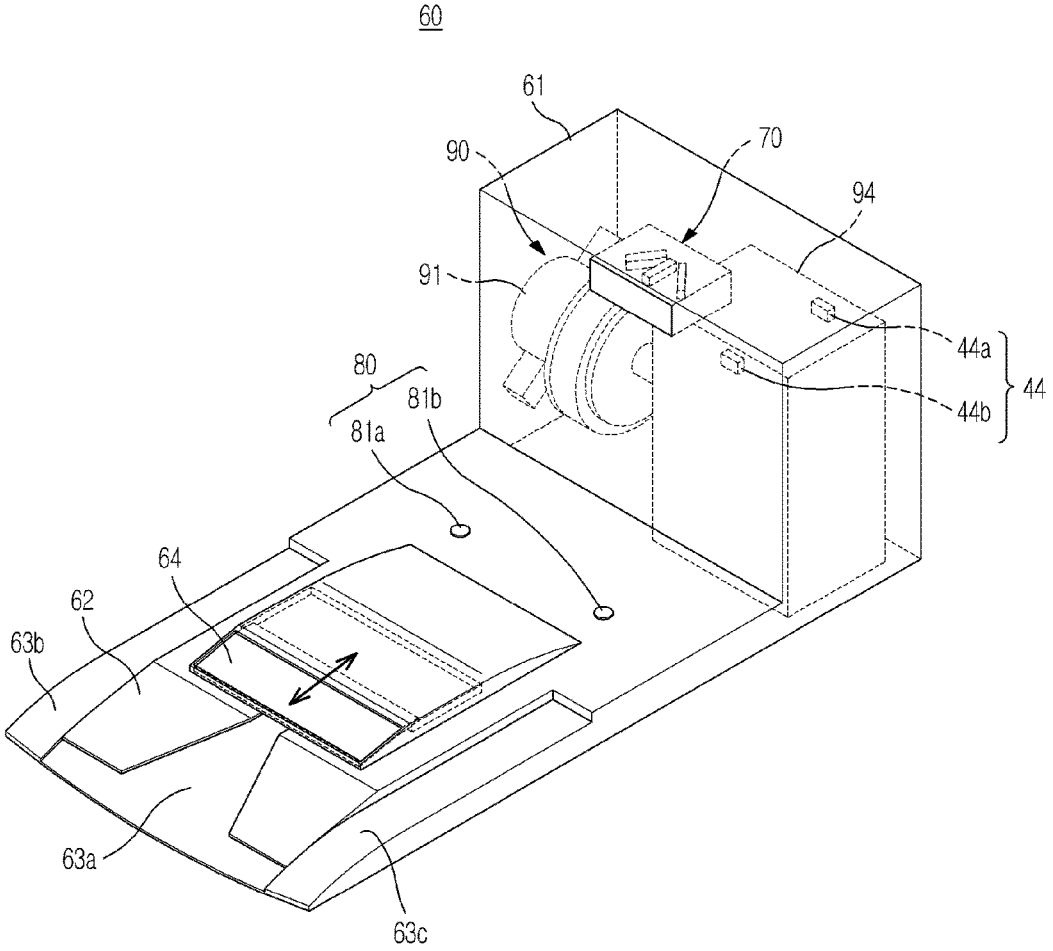
FIG. 5B is a top perspective view illustrating a configuration of the maintenance station according to another exemplary embodiment of the present disclosure.
Figure 5C:
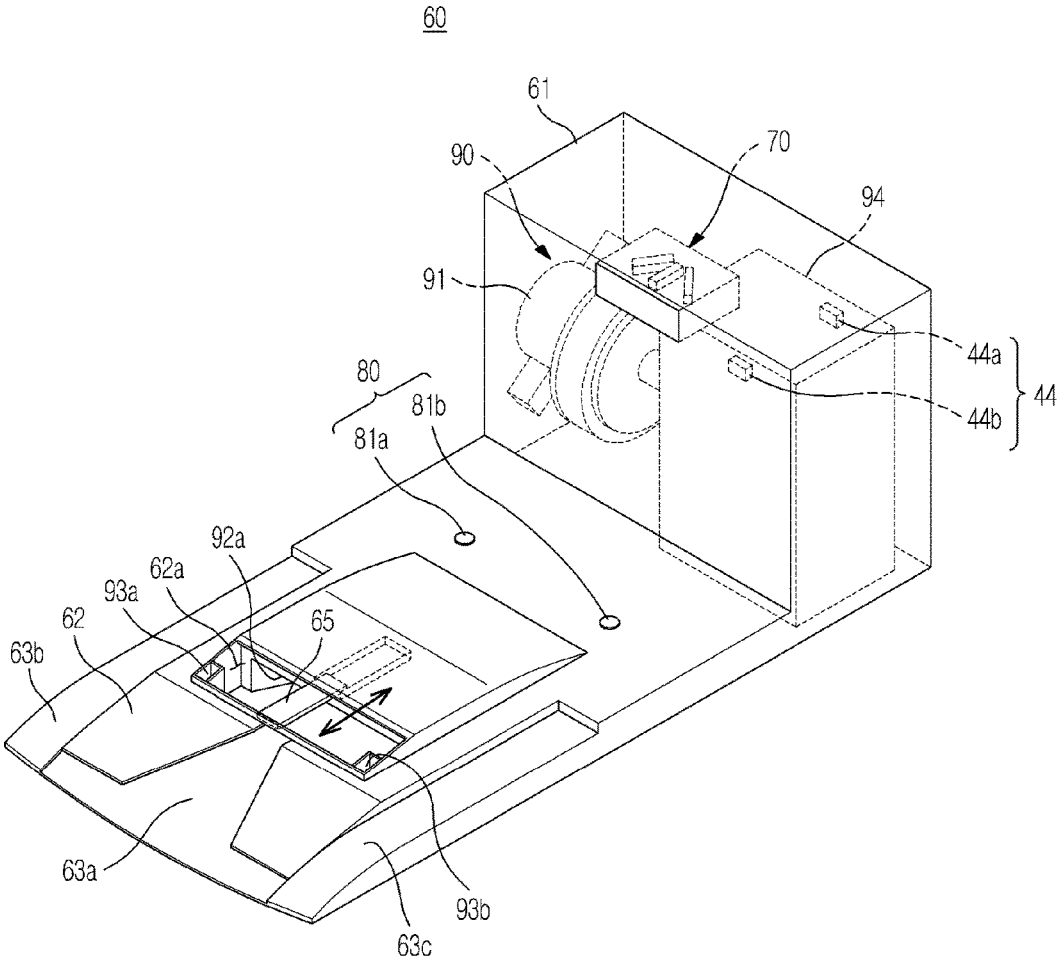
FIG. 5C is a top perspective view illustrating a configuration of the maintenance station according to another exemplary embodiment of the present disclosure.
Figure 5D:
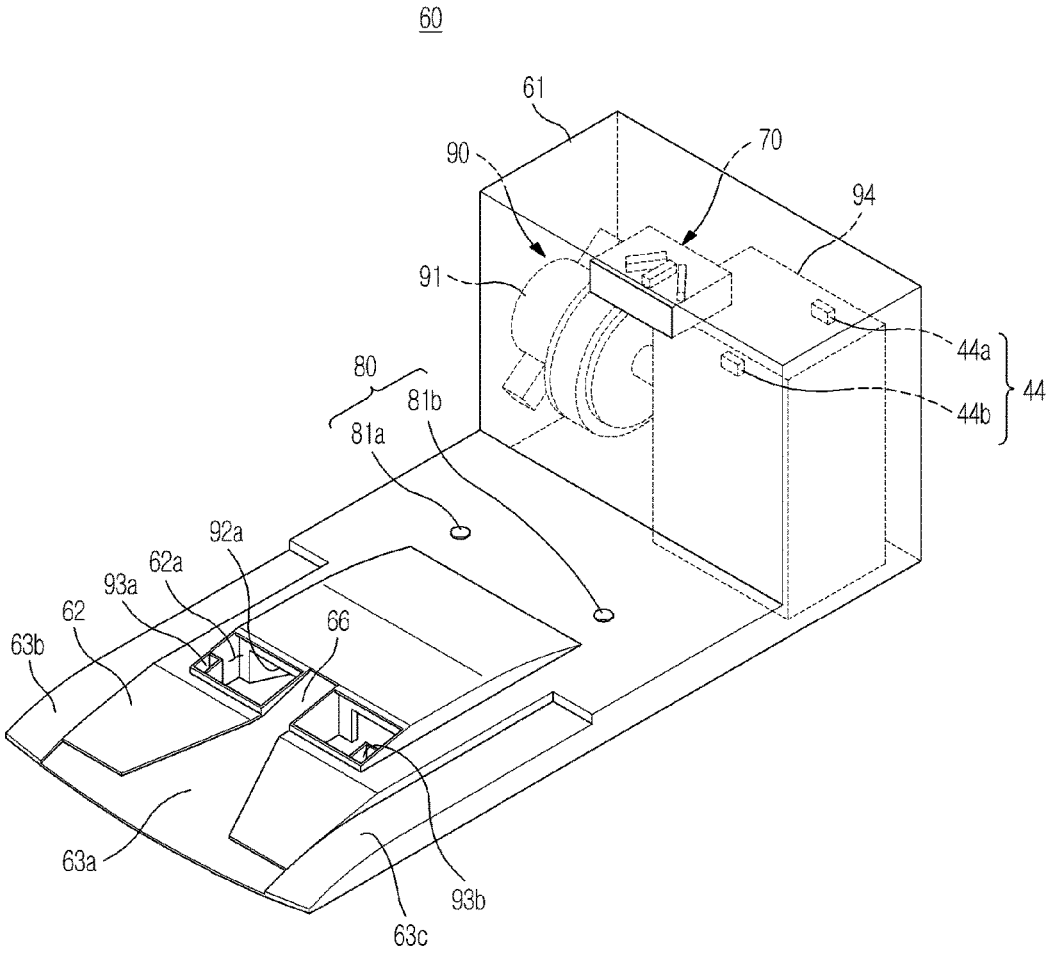
FIG. 5D is a top perspective view illustrating a configuration of the maintenance station according to another exemplary embodiment of the present disclosure.
Figure 5E:
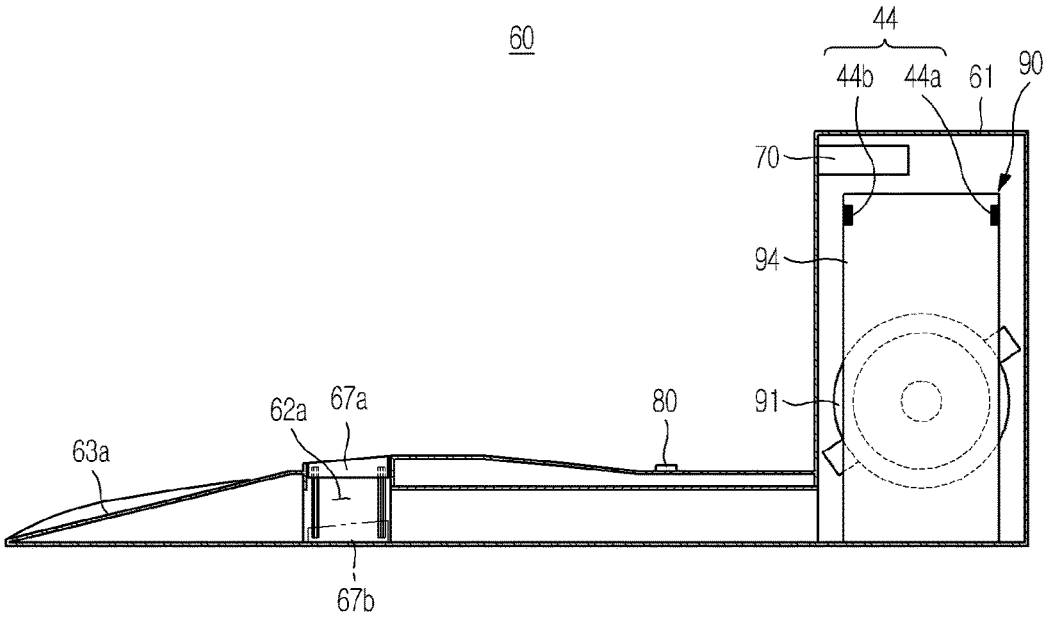
FIG. 5E is a sectional view illustrating a configuration of the maintenance station according to another exemplary embodiment of the present disclosure.
Figure 6:
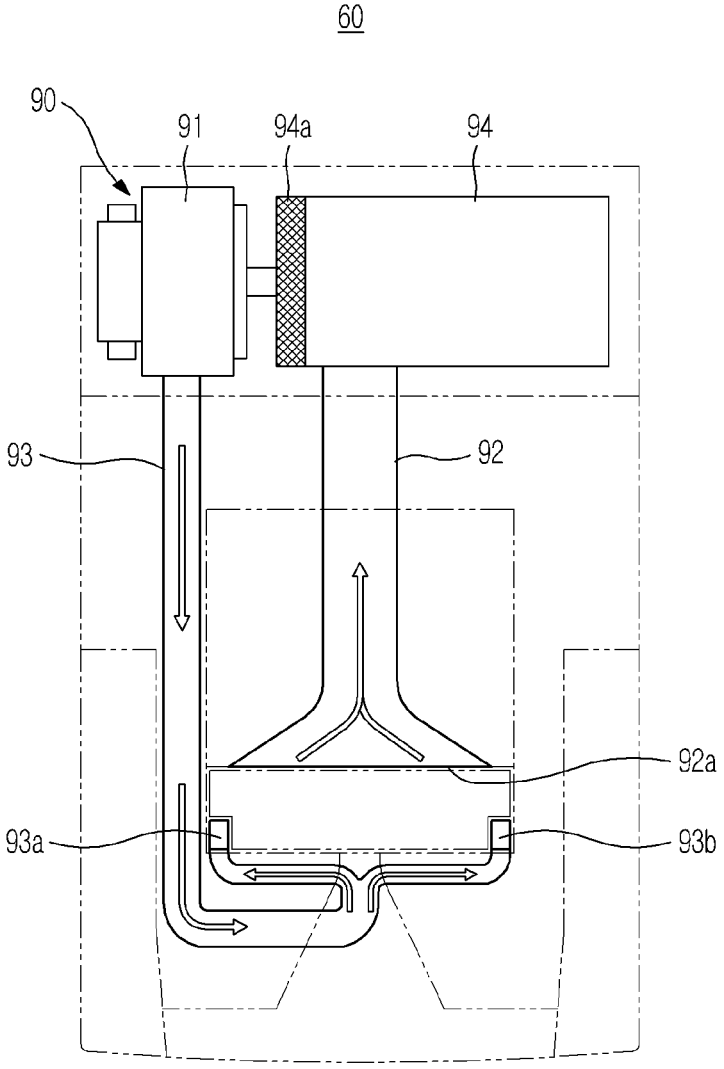
FIG. 6 is a plan view illustrating a duct included in the maintenance station according to the embodiment of FIG. 5A.
Figure 7:
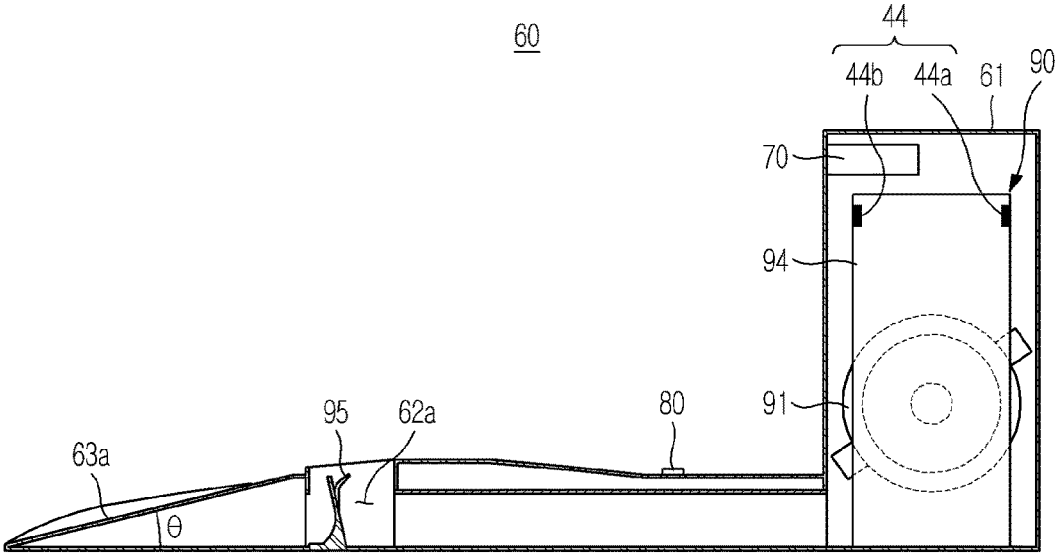
FIG. 7 is a plan view illustrating the maintenance station according to the embodiment of FIG. 5A.

FIG. 5A is a perspective view illustrating a top perspective view illustrating a configuration of the maintenance station according to an exemplary embodiment of the present disclosure. FIG. 5B is a top perspective view illustrating a configuration of the maintenance station according to another exemplary embodiment of the present disclosure. FIG. 5C is a top perspective view illustrating a configuration of the maintenance station according to another exemplary embodiment of the present disclosure. FIG. 5D is a top perspective view illustrating a configuration of the maintenance station according to another exemplary embodiment of the present disclosure. FIG. 5E is a sectional view illustrating a configuration of the maintenance station according to another exemplary embodiment of the present disclosure. FIG. 6 is a plan view illustrating a duct included in the maintenance station according to the embodiment of FIG. 5A. FIG. 7 is a plan view illustrating the maintenance station according to the embodiment of FIG. 5A.

As shown in FIGS. 1 to 7, the robot cleaner 20 may dock with the maintenance station 60 in various situations. For example, there may be various situations such as a situation in which the battery (not shown) of the robot cleaner 20 needs to be charged, a situation in which the robot cleaner 20 has performed a cleaning task for a predetermined time, a situation in which the robot cleaner 20 has completed a cleaning task, and a situation in which the first dust box 43 of the robot cleaner 20 is completely filled with dust.

The maintenance station 60 may include a housing 61, a docking guide unit 70, a charging unit 80, a dust removal unit 90, and a controller (not shown).

A platform 62 may be provided at the housing 61. The platform 62 may support the robot cleaner 20 while the robot cleaner 20 docks with the maintenance station 60.

The platform 62 has an inclined structure to allow the robot cleaner 20 to easily ascend along or descend from the platform 62. A caster guide 63*a* may be formed at the platform 62, to guide the caster 32 of the robot cleaner 20. Driving wheel guides 63*b* and 63*c* may also be formed at the platform 62, to guide the left and right driving wheels 31*a* and 31*b* of the robot cleaner 20. The caster guide 63*a* and driving wheel guides 63*b* and 63*c* may be formed to be recessed, as compared to portions of the platform 62 therearound.

A second opening 62*a* may be formed through the platform 62. The second opening 62*a* of the platform 62 may be arranged at a position where the second opening 62*a* may communicate with the first opening 21*a* of the robot cleaner 20. In accordance with this arrangement, dust discharged through the first opening 21*a* of the robot cleaner 20 may be introduced into the second opening 62*a* of the platform 62. The dust introduced into the second opening 62*a* of the platform 62 may be collected in a second dust box 94 included in the maintenance station 60.

The second dust box 94 of the maintenance station 60 is different from the first dust box 43 of the robot cleaner 20. The first dust box 43 of the robot cleaner 20 stores dust collected by the robot cleaner 20 during movement of the robot cleaner 20. The second dust box 94 of the maintenance station 60 collects and stores dust discharged from the first dust box 43. In this regard, the second dust box 94 of the maintenance station 60*n* may have a greater capacity than the first dust box 43 of the robot cleaner 20.

The dust sensing unit 44 may also be installed within the second dust box 94, in order to sense the amount of dust in the second dust box 94.

In this case, the dust sensing unit 44 may include a light emitting sensor 44*a* and a light receiving sensor 44*b*. When the light receiving sensor 44*b* cannot receive a signal transmitted from the light emitting sensor 44*a*, the controller may determine that the amount of dust in the second dust box 94 corresponds to a predetermined amount or more.

The second opening 62*a* of the platform 62 may have an open structure, as shown in FIG. 5A. That is, the second opening 62*a* of the platform 62 may always be open without being covered by a separate cover.

The platform 62 may be formed to be inclined at a predetermined angle θ or more (FIG. 7). When the robot cleaner 20 moves on the platform 62 inclined at the predetermined angle θ or more, the front portion of the robot cleaner 20 may be slightly lifted because the weight of the robot cleaner 20 is rearwardly biased. As a result, the caster 32 of the robot cleaner 20 may pass the second opening 62*a* of the platform 62 without falling into the second opening 62*a*.

Meanwhile, a cover 64 may be installed at the second opening 62*a* of the platform 62, to slidably move along the second opening 62*a*, as shown in FIG. 5B. When the robot cleaner 20 is completely docked, the cover 64 may be opened, to allow the robot cleaner 20 to discharge dust through the second opening 62*a* of the platform 62. On the other hand, when the docked state of the robot cleaner 20 is released, the cover 64 may be closed to close the second opening 62*a* of the platform 62.

The cover 64 may also function as a bridge upon which the caster 32 of the robot cleaner 20 will move. The cover 64 may be opened or closed in linkage with docking of the robot cleaner 20. That is, the cover 64 may be opened while or before the caster 32 passes the cover 64 during docking of the robot cleaner 20. The cover 64 may be closed while or after the caster 32 passes the cover 64 during docking release of the robot cleaner 20. It may also be possible to open or close the cover 64, using a separate device.

On the other hand, as shown in FIG. 5C, a cover 65 may be installed at the second opening 62*a* of the platform 62, to slidably move along the second opening 62*a*. Of course, the cover 65 may be installed only at a central portion of the second opening 62*a* of the platform 62 in the case of FIG. 5C, different from the case of FIG. 5B. This structure is adapted to allow the caster 32 of the robot cleaner 20 to pass the second opening 62*a* of the platform 62. The opening/closing operation of the cover 65 may be achieved in the same manner as described above.

On the other hand, as shown in FIG. 5D, a bridge 66 may be installed at the second opening 62*a* of the platform 62. The bridge 66 may be installed only at a central portion of the second opening 62*a* of the platform 62, to achieve a bridge function allowing the caster 32 of the robot cleaner 20 to pass the bridge 66.

As shown in FIG. 5E, the bridge 66 may be installed at the second opening 62*a* of the platform 62 to move upward and downward. That is, when the robot cleaner 20 enters the platform 62, the bridge 67*a* moves upward to allow the caster 32 of the robot cleaner 20 to move thereon. When the docking of the robot cleaner 20 is completed, the bridge 67*b* moves downward to allow the second opening 62*a* of the platform 62 to secure an increased opening area.

The docking guide unit 70 may be installed at an upper portion of the housing 61. The docking guide unit 70 may include a plurality of sensors 71. The sensors 71 may define a docking guide region and a docking region, to accurately guide the robot cleaner 20 to dock with the maintenance station 60.

The charging unit 80 may be installed at the platform 62. The charging unit 80 may include a plurality of connecting terminals 81*a* and 81*b*. The connecting terminals 81*a* and 81*b* may correspond to a plurality of connecting terminals 23*a* and 23*b* provided at the robot cleaner 20. When docking of the robot cleaner 20 is completed, current may be supplied to the plural connecting terminals 23*a* and 23*b* of the robot cleaner 20 via the plural connecting terminals 81*a* and 81*b* of the maintenance station 60.

The charging unit 80 may supply current after determining whether or not the plural connecting terminals 23*a* and 23*b* of the robot cleaner 20 are connected to the charging unit 80. That is, when the charging unit 80 is connected to an element other than the plural connecting terminals 23*a* and 23*b*, the charging unit 80 interrupts supply of current, to avoid occurrence of an accident.

The dust removal unit 90 may be installed at the housing 61. The dust removal unit 90 may discharge dust stored in the first dust box 43 of the robot cleaner 20 into the second dust box 94 of the maintenance station 60, to empty the first dust box 43. Thus, the dust removal unit 90 may maintain desired cleaning performance of the robot cleaner 20.

The dust removal unit 90 may include a pump unit 91, a suction duct 92, and a discharge duct 93, in addition to the second dust box 94. The dust removal unit 90 functions to force a flow of air discharged from the discharge duct 93 to be sucked back into the suction duct 92. Using such a circulating air flow, the dust removal unit 90 removes dust stored in the first dust box 43 of the robot cleaner 20.

The pump unit 91 is a device to suck/discharge air. The pump unit 91 may include a fan and a motor.

The suction duct 92 may be installed at a suction side of the pump unit 91. The suction duct 92 may include a suction port 92*a*, which may form a portion of the second opening 62*a*. Alternatively, the suction port 92*a* may be separate from the second opening 62*a*. In this case, the suction duct 92*a* may be arranged at a position adjacent to the second opening 62*a*.

The suction port 92*a* may extend in a longitudinal direction of the second opening 62*a*, to occupy a portion of the second opening 62*a*, except for a portion of the second opening 62*a* occupied by discharge ports 93*a* and 93*b* of the discharge duct 93.

The discharge duct 93 may be installed at a discharge side of the pump unit 91. The discharge duct 93 may be divided into two portions, which form the two discharge ports 93*a* and 93*b*. The discharge ports 93*a* and 93*b* may form portions of the second opening 62*a*. Alternatively, the discharge ports 93*a* and 93*b* may be separate from the second opening 62*a*. In this case, the discharge ports 93*a* and 93*b* may be arranged at positions adjacent to the second opening 62*a*.

The discharge ports 93*a* and 93*b* may be formed at longitudinal ends of the second opening 62*a*, namely, opposite side regions of the second opening 62*a*, respectively.

The suction port 92*a* of the suction duct 92 may have a larger cross-sectional area than the sum of the cross-sectional areas of the discharge ports 93*a* and 93*b* of the discharge duct 93. Hereinafter, the sum of the cross-sectional areas of the discharge ports 93*a* and 93*b* of the discharge duct 93 will be simply referred to as "the cross-sectional area of the discharge ports 93*a* and 93*b*". The cross-sectional area ratio between the suction port 92*a* of the suction duct 92 and the discharge ports 93*a* and 93*b* of the discharge duct may be 7.5:1. Of course, the cross-sectional area ratio of the suction port 92*a* of the suction duct 92 to the discharge ports 93*a* and 93*b* of the discharge duct may be smaller than the above-described ratio, for example, may be 7:1, 6.5:1, or 6:1. Even when the cross-sectional area ratio is slightly reduced, as described above, it falls within the technical scope of the present disclosure.

Accordingly, the air flow velocity at the discharge ports 93*a* and 93*b* of the discharge duct 93 may be higher than the air flow velocity at the suction port 92*a* of the suction duct 92 because there is a cross-sectional area difference between the suction port 92*a* and the discharge ports 93*a* and 93*b* under the condition that the suction flow rate and discharge flow rate of the pump unit 91 are substantially equal. By virtue of this flow velocity difference, it may be possible to prevent air emerging from the discharge ports 93*a* and 93*b* from being sucked into the suction port 92*a*. That is, air emerging from the discharge ports 93*a* and 93*b* may be injected into the first dust box 34 without being directly sucked into the suction port 92*a* by a suction force at the suction port 92*a*, because the air flow velocity of the discharged air is very high. Thus, air injected into the first dust box 43 may emerge from the first dust box 43 after circulating through the first dust box 34, and may then enter the suction port 92*a*.

Figure 8:
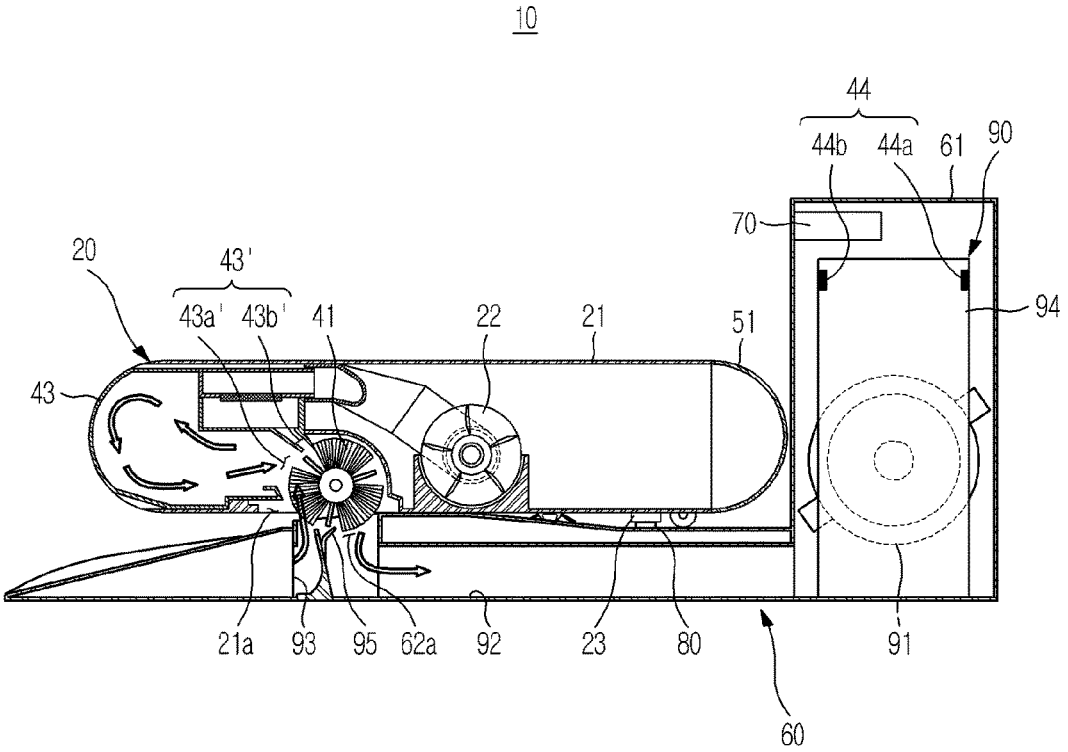
FIG. 8 is a sectional view illustrating a docking state of the robot cleaner and maintenance station.

FIG. 8 is a sectional view illustrating a docking state of the robot cleaner and maintenance station.

As shown in FIGS. 1 to 8, when the robot cleaner 20 docks with the maintenance station 60, the first opening 21*a* of the robot cleaner 20 may communicate with the second opening 62*a* of the maintenance station 60.

When docking is achieved, the suction port 92*a* of the suction duct 92 may be arranged adjacent to the first opening 21*a* of the robot cleaner 20 while extending in the longitudinal direction of the first opening 21*a*. Also, the discharge ports 93*a* and 93*b* of the discharge duct 93 may be arranged adjacent to the first opening 21*a* of the robot cleaner 20 at the longitudinal ends of the first opening 21*a* of the robot cleaner 20, namely, the opposite side regions of the first opening 21*a*, respectively.

In accordance with the above-described configuration, air circulated (returned) by the dust removing device 90 during the docking operation may form a closed loop. That is, air discharged from the pump unit 91 rapidly emerges from the discharge ports 93*a* and 93*b* of the discharge duct 93, and then enters the first dust box 43 of the robot cleaner 20 after passing through the opposite side regions of the first opening 21*a*. The air introduced into the first dust box 43 of the robot cleaner 20 is discharged through the central region of the first opening 21*a*, to be introduced into the second dust box 94 of the maintenance station 60 through the suction port 92*a* of the suction duct 92. Thereafter, the air is again sucked into the pump unit 91.

Figure 9A:
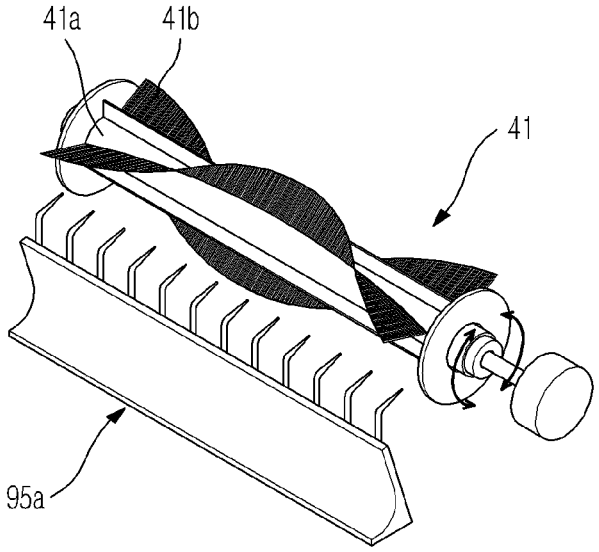
FIG. 9A is a view illustrating a configuration of a brush cleaning member according to an exemplary embodiment of the present disclosure.
Figure 9B:
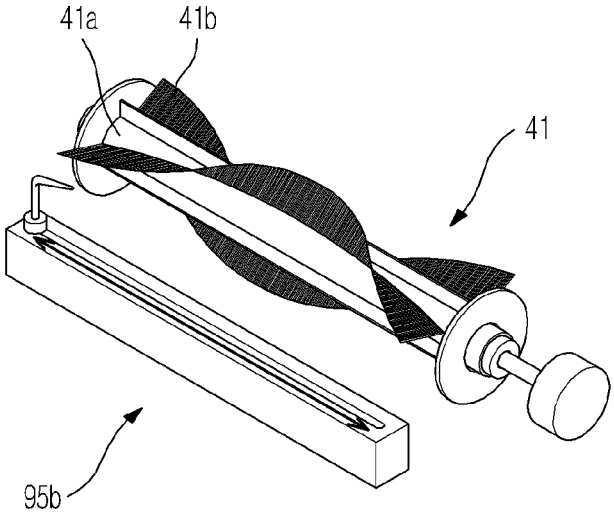
FIG. 9B is a view illustrating a configuration of the brush cleaning member according to another exemplary embodiment of the present disclosure.
Figure 9C:
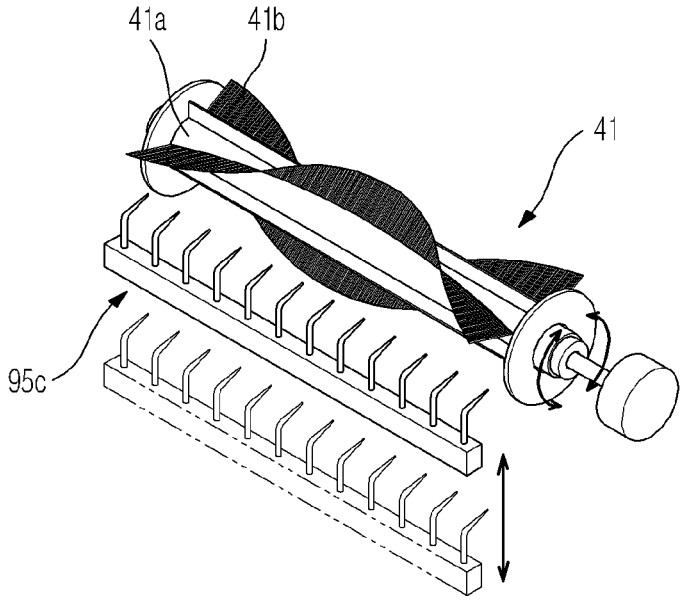
FIG. 9C is a view illustrating a configuration of the brush cleaning member according to another exemplary embodiment of the present disclosure.

FIG. 9A is a view illustrating a configuration of the brush cleaning member according to an exemplary embodiment of the present disclosure. FIG. 9B is a view illustrating a configuration of the brush cleaning member according to another exemplary embodiment of the present disclosure. FIG. 9C is a view illustrating a configuration of the brush cleaning member according to another exemplary embodiment of the present disclosure.

As shown in FIG. 9A, the maintenance station 60 may include a brush cleaning member 95*a* to clean the brush unit 41 of the robot cleaner 20. The brush cleaning member 95*a* of the maintenance station 60 is different from the brush cleaning member 41*c* of the robot cleaner 20.

The brush cleaning member 95*a* of the maintenance station 60 may be arranged adjacent to the second opening 62*a*. The brush cleaning member 95*a* of the maintenance station 60 may be protruded from the bottom of the housing 61 toward the second opening 62*a*. The brush cleaning member 95*a* may include a plurality of brush cleaning members arranged in a longitudinal direction of the second opening 62*a*.

In a docking state, the brush cleaning member 95*a* of the maintenance station 60 may be in contact with the brush unit 41 of the robot cleaner 20. The brush cleaning member 95*a* of the maintenance station 60 may remove foreign matter such as hairs wound around the brush unit 41 of the robot cleaner 20. In particular, the foreign matter removed by the brush cleaning member 95*a* of the maintenance station 60 may be introduced into the second dust box 94 by the suction force of the pump unit 91 because the brush cleaning member 95*a* of the maintenance station 60 may be arranged at the suction duct 92.

In accordance with another embodiment of the present disclosure, the brush cleaning member 95*b* of the maintenance station 60 may be arranged to be slidably movable in the longitudinal direction of the second opening 62*a*, as shown in FIG. 9B. The brush cleaning member 95*b* of the maintenance station 60 may remove foreign matter wound around the brush unit 41 of the robot cleaner 20 while sliding.

In accordance with another embodiment of the present disclosure, the brush cleaning member 95*c* of the maintenance station 60 may be installed to be upwardly and downwardly movable, as shown in FIG. 9C. The brush cleaning member 95*c* may move upward when the docking of the robot cleaner is completed, so that the brush cleaning member 95*c* comes into contact with the brush unit 41 of the robot cleaner 20. On the other hand, when the docking of the robot cleaner is released, the brush cleaning member 95*c* may move downward. Meanwhile, the upward and downward movement of the brush cleaning member 95*c* may be carried out in linkage with docking of the robot cleaner 20.

The brush unit 41 of the robot cleaner 20 may more effectively move dust in cooperation with the dust removal unit 90. When the dust removal unit 90 circulates air, the brush unit 41 of the robot cleaner 20 may rotate in a clockwise direction in FIG. 8. In this case, the brush unit 41 of the robot cleaner 20 may assist introduction of air into the first dust box 43 of the robot cleaner 20. Furthermore, the brush unit 41 may assist introduction of air emerging from the first dust box 43 of the robot cleaner 20 into the suction port 92*a* of the suction duct 92.

The brush unit 41 of the robot cleaner may rotate at various speeds, to more effectively move dust. For example, when the dust removal unit 90 circulates air, the brush unit 41 of the robot cleaner 20 may slowly rotate in an early stage, and may then rapidly rotate. Here, the "early stage" means a certain period of time. This period may be set to be a sufficient time to allow light dust such as hairs to be discharged. As the brush unit 41 of the robot cleaner 20 rotates slowly in the early stage, foreign matter such as relatively-light hairs may be easily moved to the suction port 92*a* of the suction duct 92 by the suction force of the dust removal unit 90. As the brush unit 41 of the robot cleaner 20 then rotates rapidly, relatively-heavy dust may be easily moved to the suction port 92*a* of the suction duct 92 by virtue of the rotating force of the brush unit 41.

The brush unit 41 of the robot cleaner 20 may remove foreign matter wound around the brush unit 41 while changing the rotation direction thereof at least one time. Dust stored in the first dust box 43 of the robot cleaner 20 may be wound around the brush unit 41 of the robot cleaner 20 because it is discharged through the first opening 21*a* of the robot cleaner 20 after passing the brush unit 41 of the robot cleaner 20. At this time, it may be possible to unwind the foreign matter wound around the brush unit 41 of the robot cleaner 20 by changing the rotation direction of the brush unit 41 of the robot cleaner 20. The unwound foreign matter is moved to the suction port 92*a* of the suction duct 92, and is then stored in the second dust box 94 of the maintenance station 60. Subsequently, the brush unit 41 of the robot cleaner 20 may again change the rotation direction, so as to rotate in the original direction. The brush unit 41 of the robot cleaner 20 may repeat the change of the rotation direction several times.

Hereinafter, operation of the cleaning system according to an exemplary embodiment of the present disclosure will be described.

As shown in FIGS. 1 to 9C, the robot cleaner 20 may sense a signal from the docking guide unit 70, to accurately dock with the maintenance station 60 in accordance with the sensed signal. Docking is initiated as the body 21 enters the platform 62, starting from the front portion of the body 21. Docking is completed at a position where the first opening 231*a* of the robot cleaner 20 communicates with the second opening 62*a* of the maintenance station 60.

Upon completion of docking, the dust removal unit 90 may discharge dust stored in the robot cleaner 20 to the maintenance station 60. In detail, the pump unit 91 may discharge air at a high flow velocity through the discharge ports 93*a* and 93*b* of the discharge duct 93. The air emerging from the discharge ports 93*a* and 93*b* may be introduced into the first dust box 43 after passing through the first opening 21*a* of the robot cleaner 20. The air introduced into the first dust box 43 of the robot cleaner 20 may completely circulate the entire space of the first dust box 43 without forming a dead space in the first dust box 43. In particular, air emerging from the discharge ports 93*a* and 93*b* may completely stir dust, starting from the side portion of the first dust box 43, because the discharge ports 93*a* and 93*b* are arranged at the opposite side regions of the first opening 20*a* of the robot cleaner 20 as viewed in the longitudinal direction of the first opening 20*a*. Subsequently, the dust stored in the first dust box 43 may be suspended in the air introduced into the first dust box 43, and may then be discharged through the first opening 21*a*, along with the air introduced into the first dust box 43. The suction port 92*a* of the suction duct 92 applies a suction force to the first opening 21*a* of the robot cleaner 20, thereby causing dust emerging from the first dust box 43 of the robot cleaner 20 to be sucked. The dust introduced into the suction port 92*a* of the suction duct 92 may be stored in the second dust box 94 of the maintenance station 60. Air is again sucked into the pump unit 91 via a filter 94*a*.

Thus, the air discharged from the pump unit 91 may be reintroduced into the pump unit 91 after sequentially passing through the discharge duct 93, the first opening 21*a* of the robot cleaner 20, the first dust box 43 of the robot cleaner 20, the first opening 21*a* of the robot cleaner 20, the suction duct 92, and the second dust box 94 of the maintenance station 60. As air circulates (returns) as described above, it may be possible to maximally prevent outward discharge of air. Accordingly, it may be possible to reduce the performance of the filter 94*a*. Furthermore, it may be possible to achieve suction/discharge of air, using a single pump unit as the pump unit 91.

Dust emerging from the first dust box 43 of the robot cleaner 20 may be moved to a large central region of the first opening 21*a* of the robot cleaner 20 and a large central region of the second opening 62*a* of the maintenance station 60 because the air emerging from the discharge ports 93*a* and 93*b* of the discharge duct 93 may be discharged through the opposite side regions of the first opening 21*a* of the robot cleaner 20 and second opening 62*a* of the maintenance station 60 as viewed in the longitudinal direction of the first and second openings 21*a* and 62*a*, and the air sucked at the suction port 92*a* of the suction duct 92 may be sucked through the large regions of the first opening 21*a* of the robot cleaner 20 and second opening 62*a* of the maintenance station 60 as viewed in the longitudinal direction of the first and second openings 21*a* and 62*a*. The arrangements of the suction port 92*a* and discharge ports 93*a* and 93*b* may prevent dust emerging from the first dust box 43 of the robot cleaner 20 from moving through the opposite side regions, and thus may prevent the dust from being outwardly discharged. The positions of the suction port 92*a* and discharge ports 93*a* and 93*b* with regard to the first opening 21*a* of the robot cleaner 20 and the second opening 62*a* of the maintenance station 60 may provide a certain sealing effect between the robot cleaner 20 and the maintenance station 60.

Meanwhile, the brush unit 41 may be controlled to rotate slowly in an early stage, and then to rotate rapidly while the dust removal unit 90 circulates air, in order to assist the dust removal unit 90. In detail, the brush unit 41 assists, in the early stage, the dust removal unit 90 to rapidly suck light dust such as hairs while rotating slowly. Subsequently, the brush unit 41 assists the dust removal unit 90 to suck relatively-heavy dust while rotating rapidly.

Furthermore, the brush unit 41 may be controlled to change the rotation direction thereof at least one time while the dust removal unit 90 circulates air, in order to assist the dust removal unit 90. In detail, foreign matter such as hairs may be wound around the brush unit 41. The wound foreign matter such as hairs may be unwound as the rotation direction of the brush unit 41 is changed. In this case, the dust removal unit 90 may suck the foreign matter such as hairs off of the brush unit 41.

Meanwhile, the brush cleaning member 95 of the maintenance station 60 may remove foreign mater such as hairs wound around the brush unit 41 of the robot cleaner 20. Foreign matter wound around the brush unit 41 of the robot cleaner 20 during rotation of the brush unit 41 comes into contact with the brush cleaning member 95 of the maintenance station 60, so that the foreign matter may be removed from the brush unit 41 by the brush cleaning member 95 of the maintenance station 60. The removed foreign matter may be collected in the second dust box 94 by the suction force of the dust removal unit 90.

Figure 10:
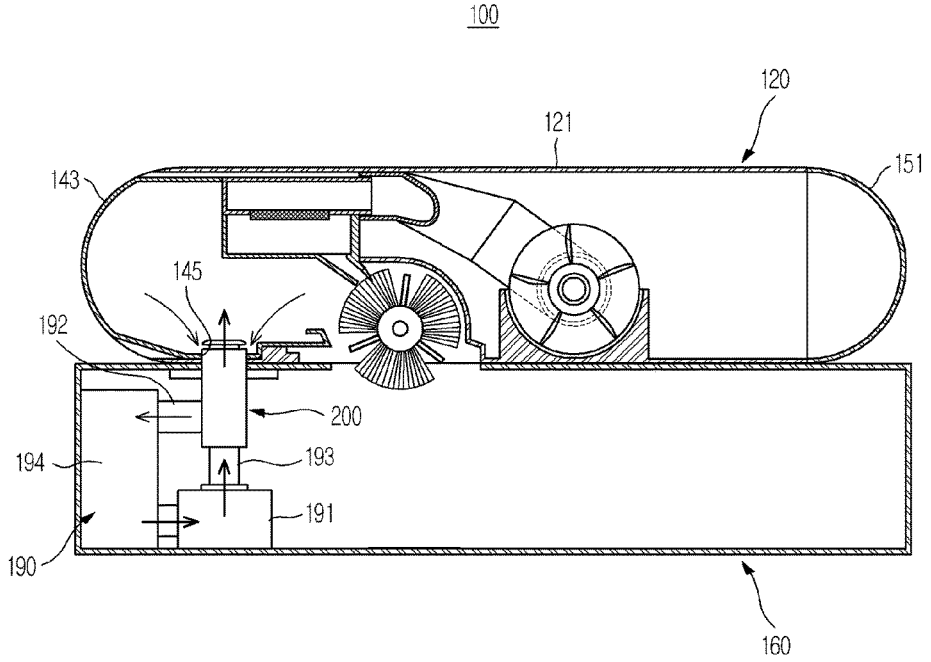
FIG. 10 is a view schematically illustrating a cleaning system according to another exemplary embodiment of the present disclosure.
Figure 11:
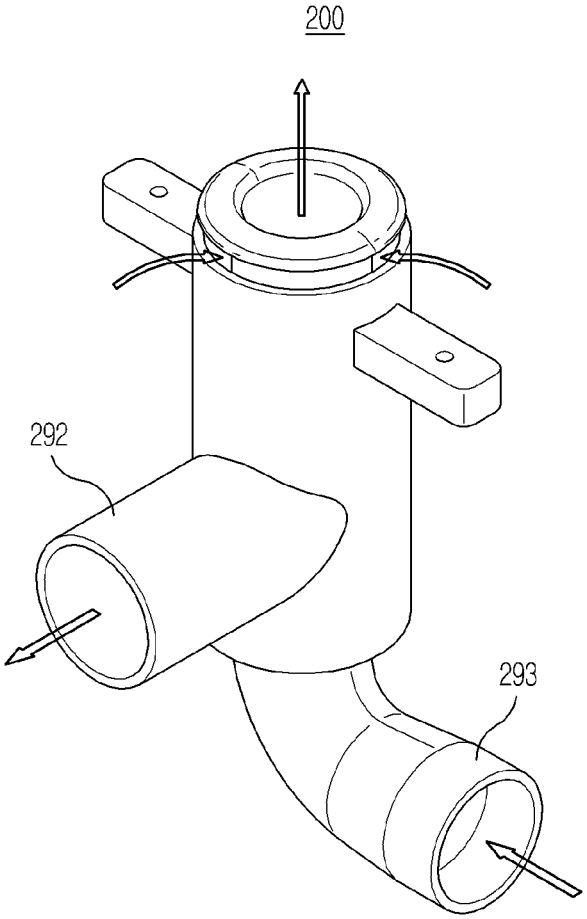
FIG. 11 is a perspective view illustrating a suction/discharge dual tube.
Figure 12:
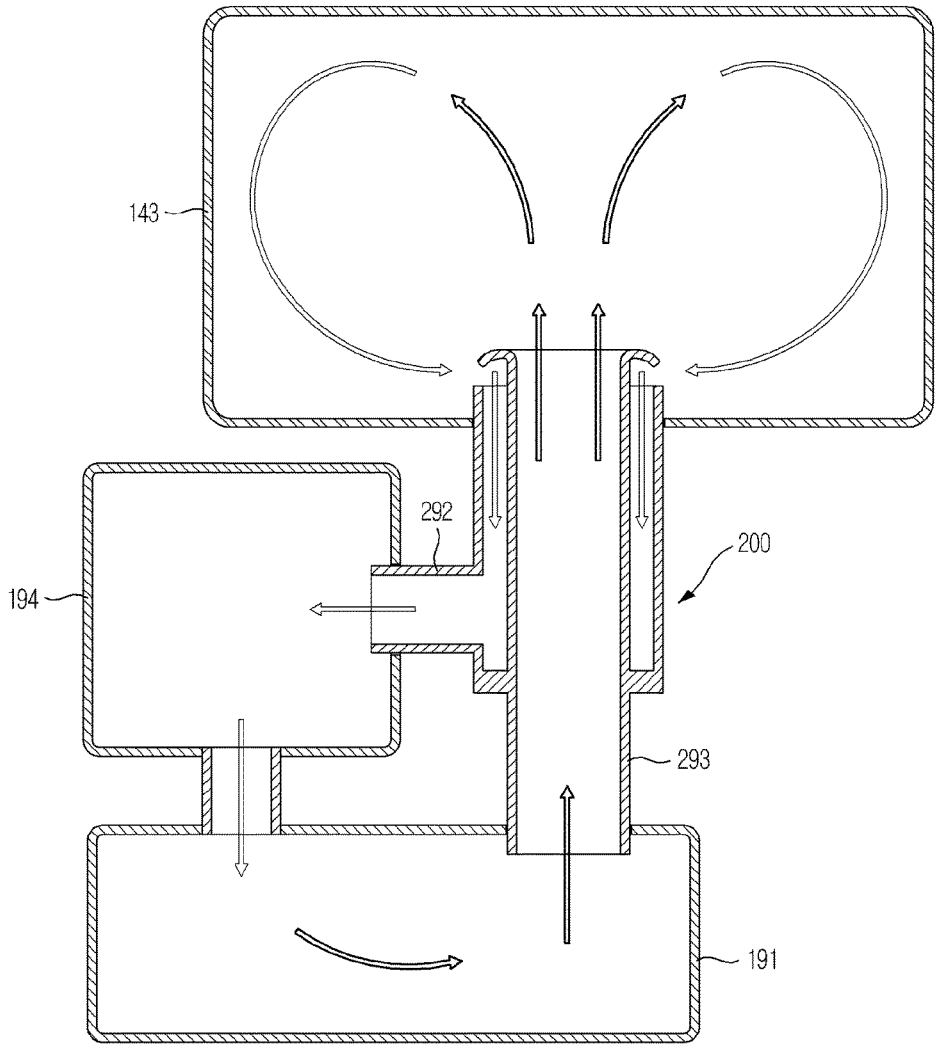
FIG. 12 is a view illustrating flow of air in the cleaning system according to the embodiment shown in FIG. 10.

FIG. 10 is a view schematically illustrating a cleaning system according to another exemplary embodiment of the present disclosure. FIG. 11 is a perspective view illustrating a suction/discharge dual tube. FIG. 12 is a view illustrating flow of air in the cleaning system according to the embodiment shown in FIG. 10.

As shown in FIGS. 10 to 12, the cleaning system 100 may discharge dust stored in a first dust box 143 included in a robot cleaner 120 to a second dust box 194 included in a maintenance station 160. The following description will be given only in conjunction with matters different from those of the previous embodiments.

The maintenance station 160 may include a suction/discharge dual tube 200, to which a suction air flow and a discharge air flow are applied. Here, the "suction air flow" is an air flow emerging from the first dust box 143 of the robot cleaner 120, whereas the "discharge air flow" is an air flow introduced into the first dust box 143 of the robot cleaner 120. When docking is carried out, the first dust box 143 of the robot cleaner 120 may be coupled with the suction/discharge dual tube 200 of the maintenance station 160 via a communicating member 145.

The suction/discharge dual tube 200 may have a concentric dual tube structure. For example, the suction/discharge dual tube 200 may include a discharge tube 293 arranged at a central portion of the suction/discharge dual tube 200, and a suction tube 292 surrounding an outer peripheral surface of the discharge tube 293.

On the other hand, the suction/discharge dual tube may have a parallel dual tube structure in accordance with another embodiment. For example, the suction/discharge dual tube may include suction and discharge tubes arranged in parallel in a longitudinal direction or in a lateral direction.

The maintenance station 160 may include a dust removal unit 190. The dust removal unit 190 may include a pump unit 191, a suction duct 192 installed at a suction side of the pump unit 191, and connected to the suction tube 292 of the suction/discharge dual tube 200, a discharge duct 193 installed at a discharge side of the pump unit 191, and connected to the discharge tube 293 of the suction/discharge dual tube 200, and a second dust box 194.

When the robot cleaner 20 docks with the maintenance station 160, air discharged from the pump unit 191 may be introduced into the first dust box 143 of the robot cleaner 120 after entering the discharge tube 293 of the suction/discharge dual tube 200 via the discharge duct 193. Thereafter, the air introduced into the first dust box 143 may pass through the suction duct 192 after being sucked into the suction tube 292 of the suction/discharge dual tube 200, along with dust stored in the first dust box 143. The dust passing through the suction duct 192 may be stored in the second dust box 194, and may then be sucked into the pump unit 191 again.

Thus, the air discharged from the pump unit 191 may be reintroduced into the pump unit 191 after sequentially passing through the discharge duct 193, the discharge tube 293 of the suction/discharge dual tube 200, the first dust box 143 of the robot cleaner 120, the suction tube 292 of the suction/discharge dual tube 200, the suction duct 192, and the second dust box 194 of the maintenance station 160.

Figure 13:
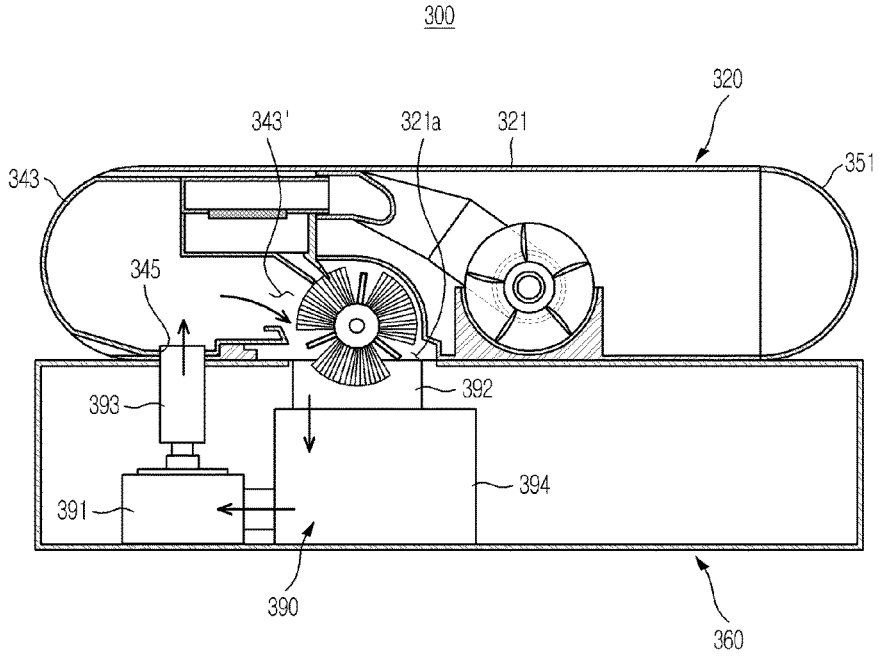
FIG. 13 is a view schematically illustrating a cleaning system according to another embodiment of the present disclosure.

FIG. 13 is a view schematically illustrating a cleaning system according to another embodiment of the present disclosure.

As shown in FIG. 13, the cleaning system 300 may discharge dust stored in a first dust box 343 included in a robot cleaner 320 to a second dust box 394 included in a maintenance station 360. The following description will be given only in conjunction with matters different from those of the previous embodiments.

The first dust box 343 of the robot cleaner 320 may include an inlet communicating with a first opening 321*a* included in the robot cleaner 320, and a communicating member 345 to directly communicate with the maintenance station 360.

The maintenance station 360 may include a dust removal unit 390. The dust removal unit 390 may include a pump unit 391, a suction duct 392 installed at a suction side of the pump unit 391, and a discharge duct 393 installed at a discharge side of the pump unit 391.

When the robot cleaner 320 docks with the maintenance station 360, the first opening 321*a* of the robot cleaner 320 may be connected to the suction duct 392 of the maintenance station 360, and the communicating member 345 of the first dust box 343 in the robot cleaner 320 may be connected to the discharge duct 393 of the maintenance station 360.

Air discharged from the pump unit 391 may be introduced into the first dust box 343 of the robot cleaner 320 via the discharge duct 393. The air introduced into the first dust box 343 of the robot cleaner 320 may be moved to the suction duct 392 after passing through the inlet 343' of the first dust box 343 and the first opening 321*a* of the robot cleaner 320, along with dust stored in the first dust box 343. The dust moved to the suction duct 392 is stored in the second dust box 394 of the maintenance station 360, whereas the air may be sucked into the pump unit 391 again.

Thus, the air discharged from the pump unit 391 may be reintroduced into the pump unit 391 after sequentially passing through the discharge duct 393, communicating member 345 of the first dust box 343, the first dust box 343 of the robot cleaner 320, the inlet 343' of the first dust box 343, the suction duct 392, and the second dust box 394 of the maintenance station 360.

Figure 14:
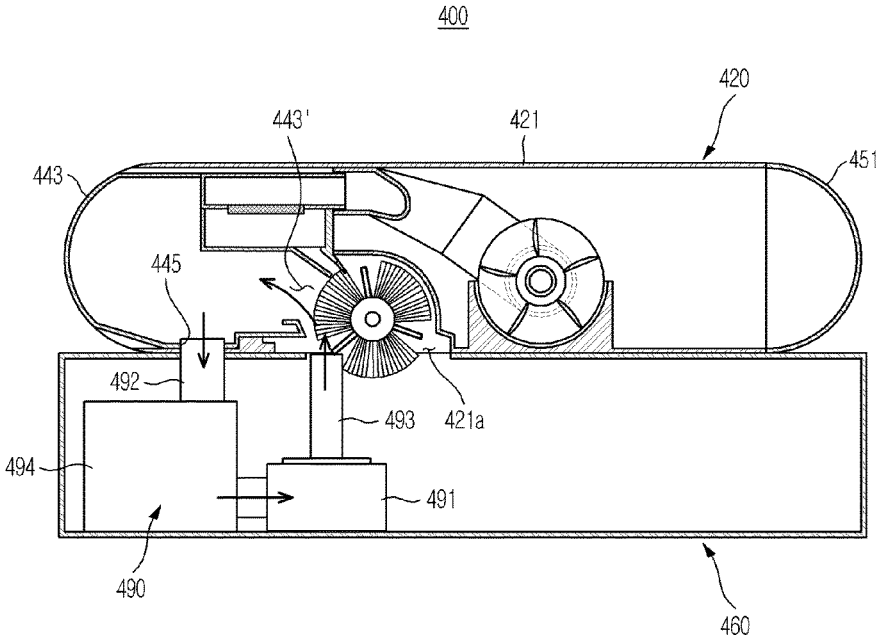
FIG. 14 is a view schematically illustrating a cleaning system according to another embodiment of the present disclosure.

FIG. 14 is a view schematically illustrating a cleaning system according to another embodiment of the present disclosure.

As shown in FIG. 14, the cleaning system 400 may discharge dust stored in a first dust box 443 included in a robot cleaner 420 to a second dust box 494 included in a maintenance station 460. The following description will be given only in conjunction with matters different from those of the previous embodiments.

When the robot cleaner 420 docks with the maintenance station 460, a first opening 421*a* of the robot cleaner 420 may be connected to a discharge duct 493 of the maintenance station 460, and a communicating member 445 included in the first dust box 443 of the robot cleaner 420 may be connected to a suction duct 492 of the maintenance station 460.

Air discharged from the pump unit 491 may be introduced into the first dust box 443 of the robot cleaner 320 via the discharge duct 493, the first opening 421*a* of the robot cleaner 420, and an inlet 443' of the first dust box 443. The air introduced into the first dust box 443 of the robot cleaner 420 may be moved to the suction duct 492 after passing through the communicating member 445 of the first dust box 443, along with dust stored in the first dust box 443. The dust moved to the suction duct 492 is stored in the second dust box 494 of the maintenance station 460, whereas the air may be sucked into the pump unit 491 again.

Thus, the air discharged from the pump unit 491 may be reintroduced into the pump unit 491 after sequentially passing through the discharge duct 493, the inlet 443' of the first dust box 443, the first dust box 443 of the robot cleaner 420, the communicating member 445 of the first dust box 443, the suction duct 492, and the second dust box 494 of the maintenance station 460.

Figure 15:
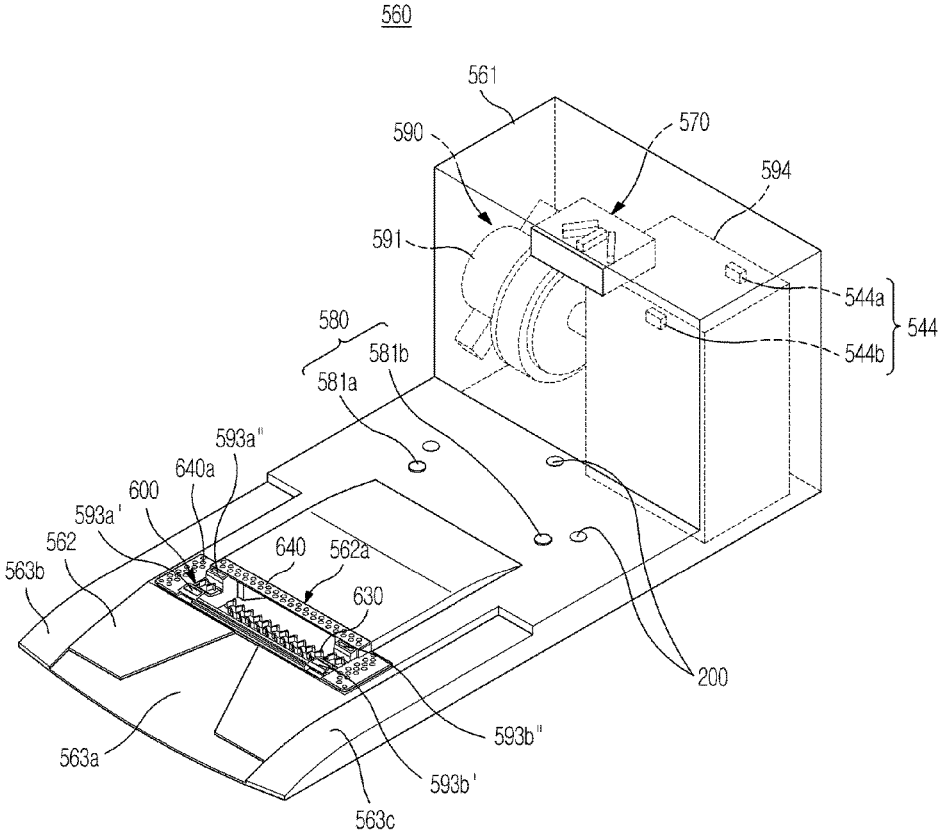
FIG. 15 is a top perspective view illustrating a configuration of the maintenance station according to another exemplary embodiment of the present disclosure.
Figure 16:
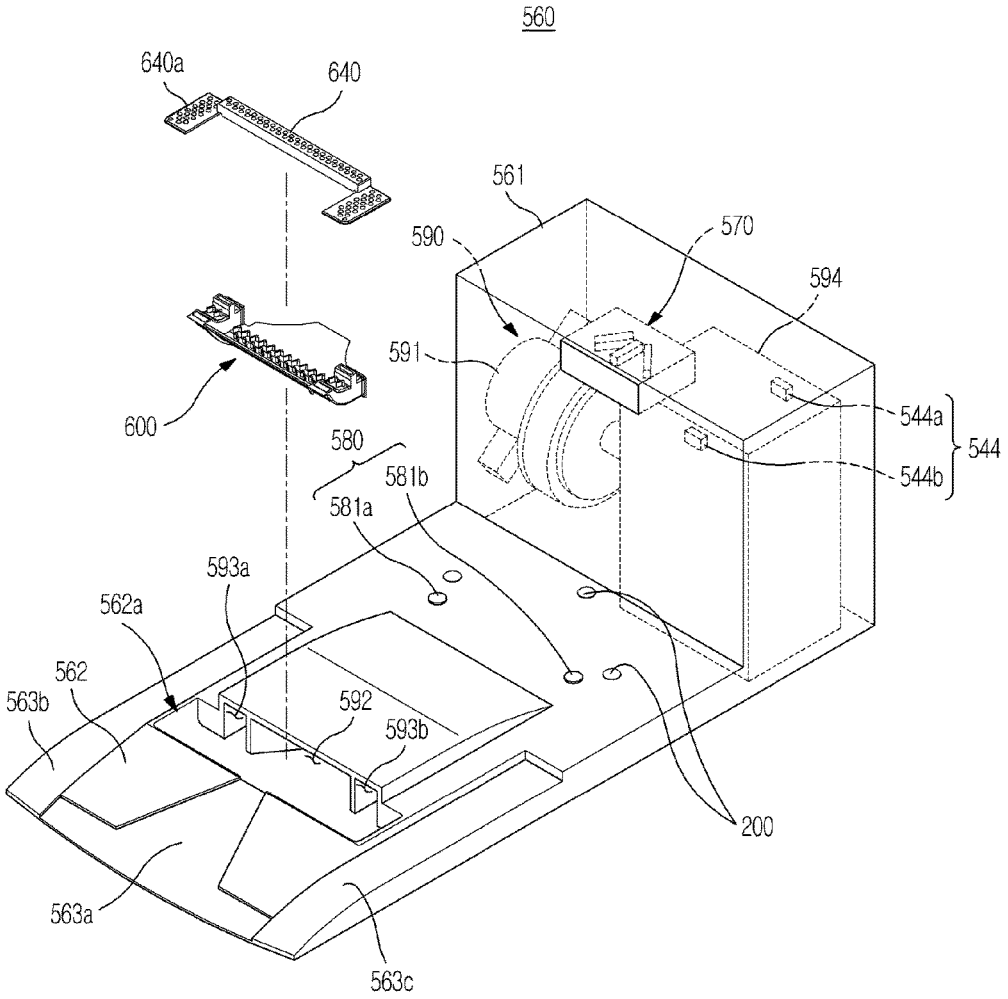
FIG. 16 is an exploded perspective view illustrating a configuration of the maintenance station according to the illustrated embodiment of the present disclosure.
Figure 17:
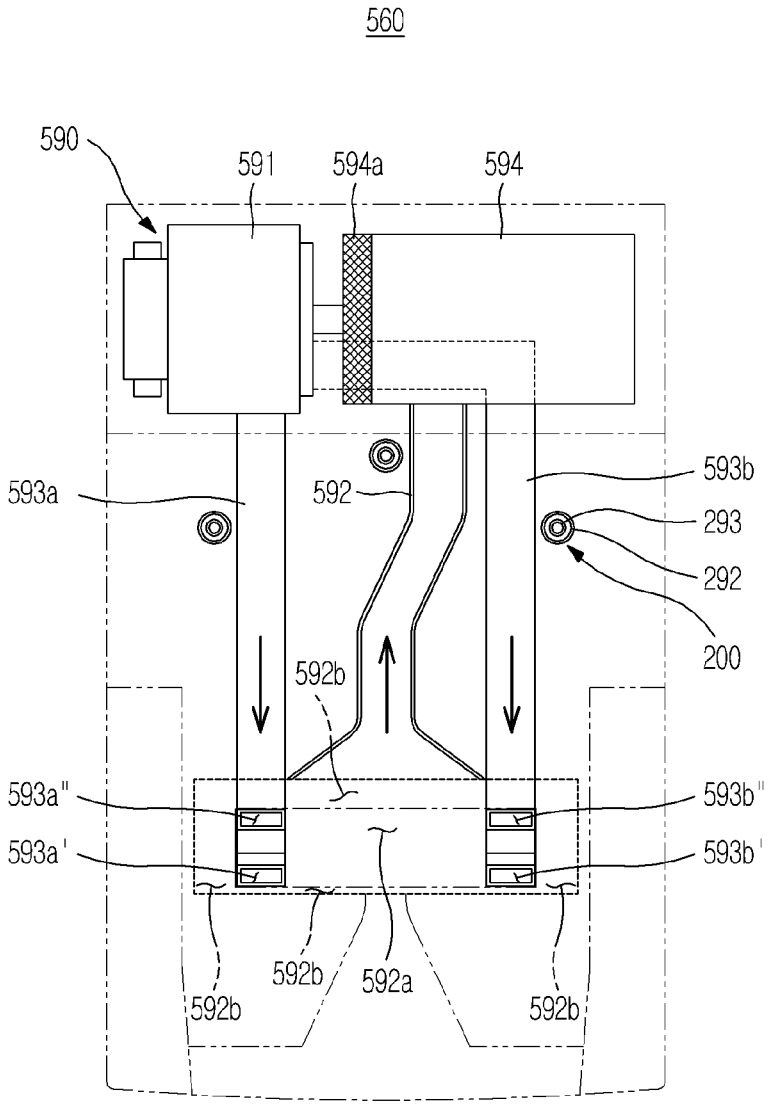
FIG. 17 is a plan view illustrating a duct included in the maintenance station according to the illustrated embodiment of the present disclosure.
Figure 18:
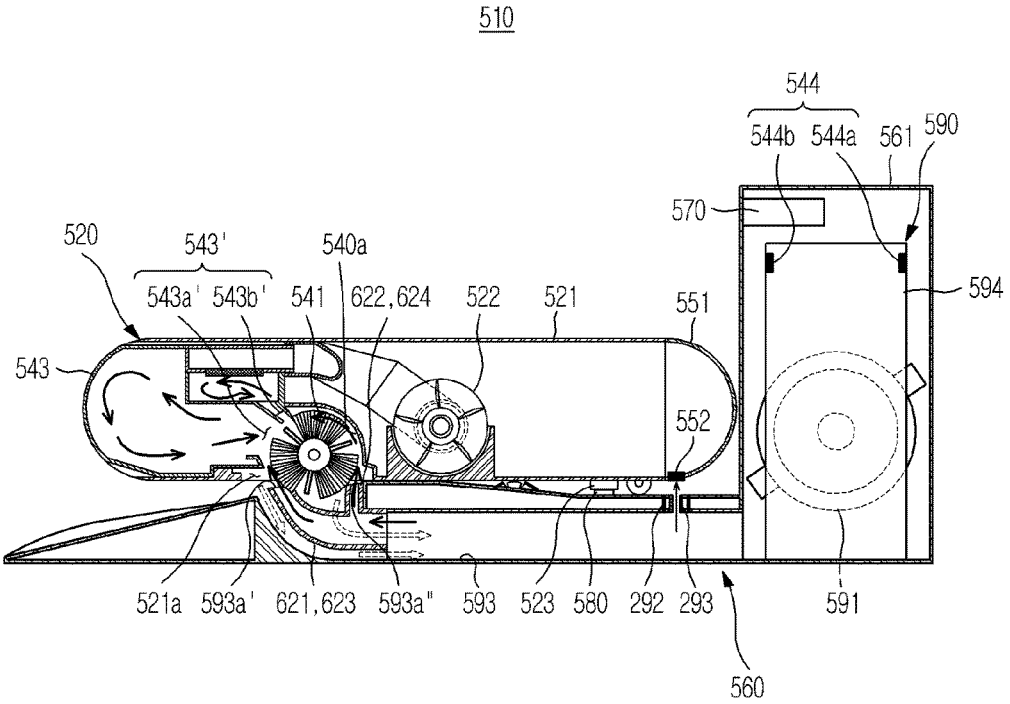
FIG. 18 is a sectional view illustrating a flow of air discharged through a second opening during a docking operation.
Figure 19:
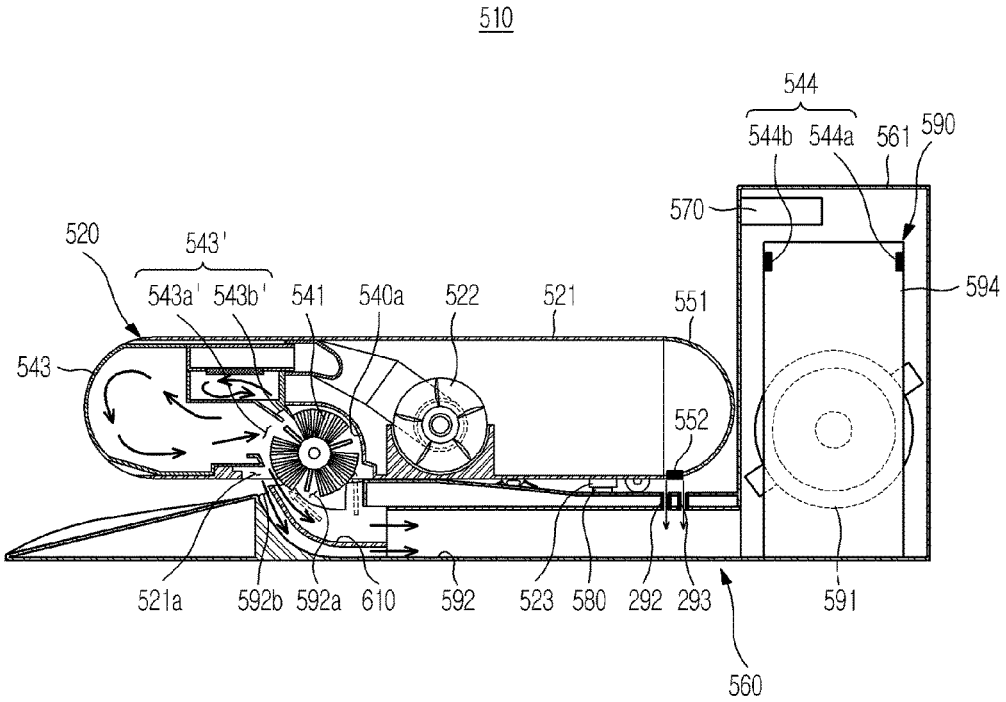
FIG. 19 is a sectional view illustrating a flow of air sucked through the second opening during the docking operation.
Figure 20:
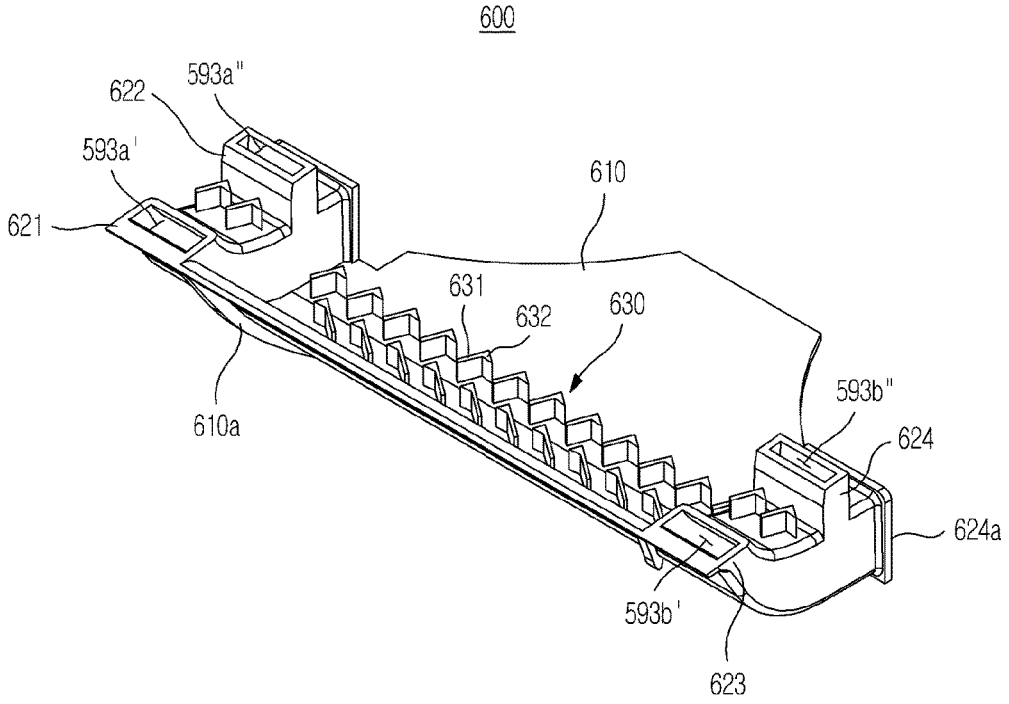
FIG. 20 is a top perspective view illustrating a port assembly according to another exemplary embodiment of the present disclosure.
Figure 21:
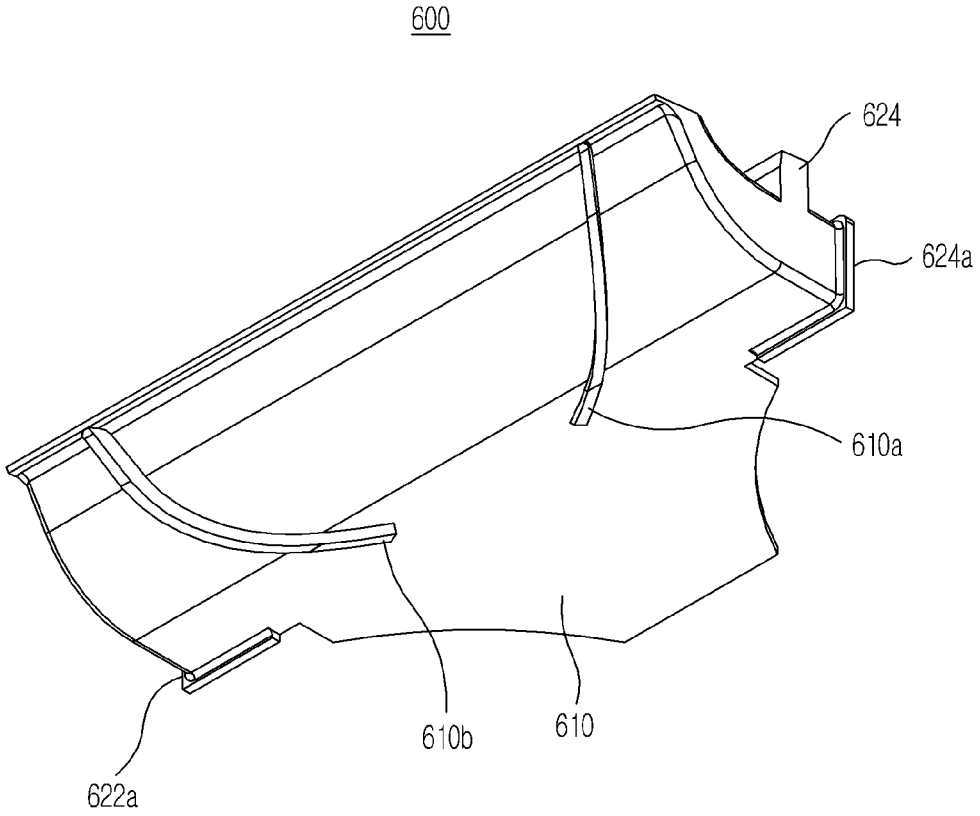
FIG. 21 is a bottom perspective view illustrating the port assembly according to the illustrated embodiment of the present disclosure.

FIG. 15 is a top perspective view illustrating a configuration of the maintenance station according to another exemplary embodiment of the present disclosure. FIG. 16 is an exploded perspective view illustrating a configuration of the maintenance station according to the illustrated embodiment of the present disclosure. FIG. 17 is a plan view illustrating a duct included in the maintenance station according to the illustrated embodiment of the present disclosure. FIG. 18 is a sectional view illustrating a flow of air discharged through a second opening during a docking operation. FIG. 19 is a sectional view illustrating a flow of air sucked through the second opening during the docking operation. FIG. 20 is a top perspective view illustrating a port assembly according to another exemplary embodiment of the present disclosure. FIG. 21 is a bottom perspective view illustrating the port assembly according to the illustrated embodiment of the present disclosure.

Referring to FIGS. 15 to 21, a cleaning system 510 is illustrated. The cleaning system 510 has the same basic structure as the above-described cleaning system 10. Accordingly, the following description will be given mainly in conjunction with portions of the cleaning system 510 different from the cleaning system 10, and no description will be given of the same portions of the cleaning system 510 as the cleaning system 10, if possible.

The maintenance station 560 may include a housing 561, a docking guide unit 570, a charging unit 580, a dust removal unit 590, and a controller (not shown).

A platform 562 may be provided at the housing 561. A second opening 562*a* may be formed at the platform 562. The second opening 562*a* of the platform 562 is arranged at a position where the second opening 562*a* may communicate with a first opening 521*a* of the robot cleaner 520. Dust discharged through the first opening 521*a* of the robot cleaner 520 may be introduced into the second opening 562*a* of the platform 562, and is then stored in a second dust box 594 of the maintenance station 560. In this case, the second opening 562*a* of the platform 562 may be larger than the first opening 521*a* of the robot cleaner 520.

The dust removal unit 590 may be installed at the housing 561. The dust removal unit 590 may discharge dust stored in the first dust box 543 of the robot cleaner 520 into the second dust box 594 of the maintenance station 560, to empty the first dust box 543. Thus, the dust removal unit 590 may maintain desired cleaning performance of the robot cleaner 520.

The dust removal unit 590 may include a pump unit 591, a suction duct 592, a first discharge duct 593*a*, a second discharge duct 593*b*, a port assembly 600, and a suction/discharge dual tube 200, in addition to the second dust box 594. The dust removal unit 590 functions to force air discharged from the first and second discharge ducts 593*a* and 593*b* to be sucked back into the suction duct 592. Using such a circulating air flow, the dust removal unit 590 removes dust stored in the first dust box 543 of the robot cleaner 520.

The suction duct 592 may be installed at a suction side of the pump unit 591. The first and second discharge ducts 593*a* and 593*b* may be installed at a discharge side of the pump unit 591. The port assembly 600 may be separably mounted to the second opening 562*a*. The port assembly 600 communicates with the suction duct 592, first discharge duct 593*a*, and second discharge duct 593*b*.

The port assembly 600 may include a suction port forming member 610, a first discharge port forming member 621, a second discharge port forming member 622, a third discharge port forming member 623, a fourth discharge port forming member 624, and a brush cleaning member 630.

The suction port forming member 610 divides the suction duct 592 into two portions, which form first and second suction ports 592*a* and 592*b*, respectively. First spacers 610*a* and 610*b* are formed at a lower surface of the suction port forming member 610. The first spacers 610*a* and 610*b* function to space the suction port forming member 610 from the bottom of the housing 561.

Air or dust introduced into the first suction port 592*a* flows toward the suction duct 592 along an upper surface of the suction port forming member 610. Air or dust introduced into the second suction port 592*b* flows toward the suction duct 592 along a lower surface of the suction port forming member 610. The dust is subsequently stored in the second dust box 594 of the maintenance station 560.

The first discharge port forming member 621 and second discharge port forming member 622 divide the first discharge duct 593*a*, into two portions, which form first and second discharge ports 593*a*' and 593*a*", respectively. On the other hand, the third discharge port forming member 623 and fourth discharge port forming member 624 divide the second discharge duct 593*b*, into two portions, which form third and fourth discharge ports 593*b*' and 593*b*", respectively.

Air discharged through the first discharge port 593*a*' and third discharge port 593*b*' is fed to a large dust box 543*a* of the robot cleaner 520, whereas air discharged through the second discharge port 593*a*" and fourth discharge port 593*b*" is fed to a small dust box 543*b* of the robot cleaner 520. The first discharge port 593*a*' and third discharge port 593*b*' directly face the large dust box 543*a*. Accordingly, air discharged through the first discharge port 593*a*' and third discharge port 593*b*' is fed to the large dust box 543*a* while passing through the brush unit 541 at high flow rate.

However, the second discharge port 593*a*" and fourth discharge port 593*b*" do not directly fact the small dust box 543*b*. For this reason, air discharged through the second discharge port 593*a*" and fourth discharge port 593*b*" is guided by a brush drum 540*a*, to be fed to the small dust box 543*b*. When the brush unit 541 rotates in a counterclockwise direction in FIG. 18, air discharged through the second discharge port 593*a*" and fourth discharge port 593*b*" may be more smoothly fed to the small dust box 543*b*.

The first discharge port 593*a*' and third discharge port 593*b*' are arranged at opposite longitudinal (or lateral) ends of the second opening 562*a*, namely, opposite side regions of the second opening 562*a*, respectively. Also, the second discharge port 593*a*" and fourth discharge port 593*b*" are arranged at opposite longitudinal (or lateral) ends of the second opening 562*a*, namely, opposite side regions of the second opening 562*a*, respectively. On the other hand, the first discharge port 593*a*' and second discharge port 593*a*" are arranged at opposite ends of the second opening 562*a* in a width (forward or backward) direction in one side region of the second opening 562*a*, respectively. Also, the third discharge port 593*b*' and fourth discharge port 593*b*" are arranged at opposite ends of the second opening 562*a* in the width (forward or backward) direction in the other side region of the second opening 562*a*, respectively. Thus, the first discharge port 593*a*' to fourth discharge port 593*b*" are arranged at respective corner regions of the second opening 562*a*.

Meanwhile, second spacers 622*a* and 624*a* are formed at side walls of the second discharge port forming member 622 and fourth discharge port forming member 624, respectively. The second spacers 622*a* and 624*a* function to prevent the port assembly 600 from being biased toward one side of the second opening 562*a*.

Thus, the second suction port 592*b* may be formed to have a structure surrounding the first suction port 592*a*, first discharge port 593*a*', second discharge port 593*a*", third discharge port 593*b*', and fourth discharge port 593*b*". The area occupied by the first suction port 592*a* and the first to fourth discharge ports 593*a*', 593*a*", 593*b*', and 593*b*" corresponds to the area of the first opening 521*a* of the robot cleaner 520. The second suction port 592*b* may suck dust dispersed outside the first opening 521*a* of the robot cleaner 520 because it is arranged outside the first opening 521*a* of the robot cleaner 520.

A cover 640 formed with a plurality of through holes 640*a* may be mounted to the second suction port 592*a*. In this case, dust dispersed outside the first opening 521*a* of the robot cleaner 520 may be sucked into the second suction port 592*b* through the through holes 640*a*. Normally, the cover 640 prevents foreign matter having a large size from entering the second suction port 592*a*, thereby preventing the suction passage from becoming clogged.

The brush cleaning member 630 is formed at the suction port forming member 610, to be protruded from the suction port forming member 610, and thus to come into contact with brushes 541*b* of the brush unit 541. A plurality of brush cleaning members 630 may be installed to be arranged in a longitudinal direction of the suction port forming member 610, as in the illustrated case. In the illustrated case, the brush cleaning members 630 are arranged in two rows in the longitudinal direction of the suction port forming member 610. In another embodiment, a plurality of brush cleaning members 630 may be arranged in one row, two rows, or more.

The brush cleaning member 630 may include a guide 631 and a hook 632.

The guide 631 extends inclinedly with respect to a rotation direction of the brush unit 541. The hook 632 is protruded from a side surface of an end of the guide 631. When the brush unit 541 rotates, the brushes 541*b*, which are made of an elastic material, are inclined in the inclined direction of the guide 631 while coming into contact with the guide 631. Accordingly, foreign matter, which may be hairs wound around the brushes 541*b*, may be caught by the hook 632 which, in turn, separates the foreign matter from the brushes 541*b*.

Meanwhile, in another embodiment, a plurality of guides 631 may be arranged in a longitudinal direction of the suction port forming member 610, and a plurality of hooks 632 may be protruded from side surfaces of guides 631, respectively. The guides 631, which are arranged in the longitudinal direction of the suction port forming member 610, may be laterally symmetrically arranged.

A plurality of suction/discharge dual tubes 200 may be provided at the platform 562. The plural suction/discharge dual tubes 200 are arranged at positions corresponding to a plurality of infrared sensors 552 installed on a bottom of the robot cleaner 520. The concrete shape of each suction/discharge dual tubes 200 may be referred to the description given with reference to FIG. 11.

Each suction/discharge dual tube 200 generates a suction air flow and a discharge air flow. Here, the suction air flow is an air flow introduced into the housing 561 through a suction tube 292 communicating with the suction duct 592, whereas the discharge air flow is an air flow outwardly discharged from the housing 561 through a discharge tube 293 communicating with the first discharge duct 593*a* or second discharge duct 593*b*.

The infrared sensors 552 of the robot cleaner 520 may be cleaned by air flowing through the corresponding suction/discharge dual tubes 200, respectively. That is, air is blown to each infrared sensor 552 of the robot cleaner 520 through the discharge tube 293 of the corresponding suction/discharge dual tube 200, to remove dust from the infrared sensor 552, and the removed dust is then sucked through the suction tube 292 of the corresponding suction/discharge dual tube 200. The dust introduced into the suction tube 292 is collected in the second dust box 594 of the maintenance station 560.

Thus, dust attached to each infrared sensor 552 is removed, so that desired sensing performance may be maintained. Since the dust removed from the infrared sensor 552 is sucked back without being dispersed, the surroundings of the station 560 may be kept clean.

As apparent from the above description, the cleaning system according to each of the illustrated embodiments may prevent the cleaning performance of the robot cleaner from being degraded.

The cleaning system may also achieve a reduction in energy and material costs by circulating air between the robot cleaner and the maintenance station.

The cleaning system may also easily achieve automatic dust discharge by discharging dust through the opening of the robot cleaner.

The cleaning system may cut off dust dispersed during automatic dust discharge, thereby keeping clean the surroundings of the maintenance station.

The cleaning system also may clean the sensors using circulating discharge air, thereby preventing dust from dispersed around the surroundings of the cleaning system.

Also, the cleaning system may effectively remove foreign matter wound on the brush unit during automatic dust discharge.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A robot cleaner comprising:

a body;

a driving unit to enable the body to autonomously travel about a region to be cleaned, the driving unit including driving wheels driven by at least one motor;

at least one sensor configured to detect an obstacle;

a cleaning unit to clean the region to be cleaned, the cleaning unit including a brush unit and a fan unit;

a dust box to store dust inside of the dust box, the dust box being detachably mounted to the body; and a dust sensing unit including a light emitting unit to transmit light and a light receiving sensor to sense the light transmitted by the light emitting unit, the light emitting unit and the light receiving sensor being fixed on the body and outside of the dust box, and the light emitting unit being configured to transmit light through the inside of the dust box, wherein the driving unit, the at least one sensor, the cleaning unit, the dust box, and the dust sensing unit are positioned on or in the body of the robot cleaner.

2. The robot cleaner according to claim 1, wherein the dust box comprises an inlet through which dust is introduced into the dust box, and the light emitting unit and the light receiving sensor are positioned at a portion of the body corresponding to the inlet of the dust box, to perform light transmission and light sensing through the inlet of the dust box, respectively.

3. The robot cleaner according to claim 2, wherein the light emitted by the light emitting unit travels horizontally across the inlet of the dust box.

4. The robot cleaner according to claim 2, wherein a direction in which light is transmitted from the light emitting unit is substantially parallel to a longitudinal direction of the inlet.

5. The robot cleaner according to claim 1, wherein a direction in which light is transmitted from the light emitting unit is different from a mounting direction of the dust box.

6. A robot cleaner comprising:

a body;

a driving unit to enable the body to autonomously travel about a surface to be cleaned, the driving unit including at least two wheels driven by at least one motor;

at least one sensor configured to detect an obstacle;

a cleaning unit to clean the surface to be cleaned by suction force;

a dust box detachably mounted to the body, the dust box including a housing forming an interior of the dust box where dust is stored; and a dust sensing unit installed to the body at a region other than the interior of the dust box, the dust sensing unit comprising a light emitting unit and a light receiving sensor, wherein light transmitted from the light emitting unit reaches the light receiving sensor after passing through the interior of the dust box, wherein the driving unit, the at least one sensor, the cleaning unit, the dust box, and the dust sensing unit are positioned on or in the body of the robot cleaner.

7. The robot cleaner according to claim 6, wherein the dust box comprises an inlet through which dust is introduced into the dust box, and the light emitting unit and the light receiving sensor are positioned at a portion of the body adjacent to the inlet of the dust box, to perform light transmission and light reception through the inlet of the dust box, respectively.

8. The robot cleaner according to claim 6, wherein the dust box comprises a transmitted-light passing portion arranged at a position corresponding to the light emitting sensor, to allow the light to enter the dust box, and a received-light passing portion arranged at a position corresponding to the light receiving sensor, to allow the light to emerge from the dust box.

9. The robot cleaner according to claim 8, wherein the transmitted-light passing portion and the received-light passing portion are made of a transparent material.

10. An autonomous cleaning apparatus comprising:

a body including an opening formed at a lower portion of the body;

a driving unit including at least two wheels driven by at least one motor to enable the body to travel;

a fan unit to make a suction force;

at least one sensor configured to detect an obstacle;

a dust box mounted to the body to store dust introduced through the opening; and a dust sensing unit installed to the body and outside of the dust box, the dust sensing unit comprising a light emitting unit and a light receiving sensor to receive light transmitted through an interior of the dust box from the light emitting unit, wherein the dust sensing unit is configured to remain installed to the body when the dust box is detached from the body.

11. The autonomous cleaning apparatus according to claim 10, wherein the light emitting unit and the light receiving sensor are installed so as to face each other.

12. The autonomous cleaning apparatus according to claim 10, wherein the dust box is mounted to the body in a first direction different from a second direction in which light is transmitted from the light emitting unit.

13. The autonomous cleaning apparatus according to claim 12, wherein the first direction is substantially perpendicular to the second direction.

14. The autonomous cleaning apparatus according to claim 12, wherein the second direction is substantially parallel to a longitudinal direction of the opening.

15. The autonomous cleaning apparatus according to claim 10, wherein if the dust box is mounted to the body, a portion of the dust box is positioned between the light emitting unit and the light receiving sensor.

16. The autonomous cleaning apparatus according to claim 10, wherein the interior of the dust box is positioned above the opening when the dust box is mounted to the body.

17. An autonomous cleaning apparatus comprising:

a body including an opening;

a driving unit including at least two wheels driven by at least one motor to enable the body to travel;

a fan unit to make a suction force;

at least one sensor configured to detect obstacles;

a dust box detachably mounted to the body to store dust to be introduced through the opening; and a dust sensing unit comprising a light emitting unit and a light receiving sensor to receive light transmitted through an interior of the dust box from the light emitting unit, wherein when the dust box is detached from the body, the light emitting unit and the light receiving sensor face each other on the body, and when the dust box is mounted on the body, the light emitting unit faces a portion of the dust box and the light receiving sensor faces another portion of the dust box.

18. An autonomous cleaning apparatus comprising:

a body including an opening;

a driving unit including at least two wheels driven by at least one motor to enable the body to travel;

a fan unit to make a suction force;

at least one sensor configured to detect obstacles;

a dust box detachably mounted to the body to store dust introduced through the opening; and a dust sensing unit installed to the body and outside of the dust box, the dust sensing unit comprising a light emitting unit and a light receiving sensor to receive light transmitted through an interior of the dust box from the light emitting unit, wherein the light emitting unit is installed at a portion of the body facing a portion of the dust box and the light receiving sensor is installed at another portion of the body facing another portion of the dust box.

* * * * *